US011053739B2

(12) United States Patent
Ainge et al.

(10) Patent No.: US 11,053,739 B2
(45) Date of Patent: Jul. 6, 2021

(54) UNDERGROUND REAMER

(71) Applicant: IRON GRIP HOLDINGS PTY LIMITED, Eastern Creek (AU)

(72) Inventors: Stephen Ainge, Eastern Creek (AU); Seyed Ali Heydarshahy, Eastern Creek (AU)

(73) Assignee: IRON GRIP HOLDINGS PTY LIMITED, Eastern Creek (AU)

( * ) Notice: Subject to any disclaimer, the term of this patent is extended or adjusted under 35 U.S.C. 154(b) by 0 days.

(21) Appl. No.: 16/768,836

(22) PCT Filed: Jan. 11, 2019

(86) PCT No.: PCT/AU2019/050014
§ 371 (c)(1),
(2) Date: Jun. 1, 2020

(87) PCT Pub. No.: WO2019/136524
PCT Pub. Date: Jul. 18, 2019

(65) Prior Publication Data

US 2021/0087887 A1 Mar. 25, 2021

(30) Foreign Application Priority Data

Jan. 11, 2018 (AU) ..... 2018900092

(51) Int. Cl.

| | |
|---|---|
| ***E21B 10/32*** | (2006.01) |
| ***E21B 10/633*** | (2006.01) |
| ***E21B 7/28*** | (2006.01) |
| *E21B 10/43* | (2006.01) |

(52) U.S. Cl.
CPC ..... *E21B 10/32* (2013.01); *E21B 7/28* (2013.01); *E21B 10/43* (2013.01); *E21B 10/633* (2013.01)

(58) Field of Classification Search
CPC . E21B 10/32; E21B 7/28; E21B 10/43; E21B 10/633
See application file for complete search history.

(56) References Cited

U.S. PATENT DOCUMENTS

| | | | |
|---|---|---|---|
| 4,270,618 | A | 6/1981 | Owens |
| 4,449,595 | A | 5/1984 | Holbert |
| 5,417,292 | A | 5/1995 | Polakoff |

(Continued)

FOREIGN PATENT DOCUMENTS

WO WO 2012/037597 3/2012

OTHER PUBLICATIONS

Australian Patent Office, International Search Report and Written Opinion of the International Searching Authority, International Application No. PCT/AU2019/050014, dated Feb. 13, 2019, 10 pages.

*Primary Examiner* — Caroline N Butcher

(57) ABSTRACT

A reamer (1) for underground passageways, comprising: a support housing (3) and a plurality of radially extending cutting wings (11); a plurality of ring segments (13), wherein each ring segment (13) includes an arcuate ring portion (15), wherein the plurality of ring segments (13) are assembled to form a stabilization ring (17) bridging radial outer edges (12) of the plurality of cutting wings (11), wherein the stabilization ring (17) is fastened to at least one of the cutting wings (11) to resist radial movement of the reamer (1).

18 Claims, 18 Drawing Sheets

(56) References Cited

U.S. PATENT DOCUMENTS

| | | | | |
|---|---|---|---|---|
| 5,992,547 | A * | 11/1999 | Caraway | E21B 10/003 175/385 |
| 2013/0248254 | A1* | 9/2013 | Ainge | E21B 10/28 175/325.5 |
| 2016/0290067 | A1* | 10/2016 | Tipples | E21B 17/1078 |
| 2017/0342793 | A1* | 11/2017 | Wesson | E21B 33/04 |

* cited by examiner

UNDERGROUND REAMER

TECHNICAL FIELD

The present disclosure relates to a reamer for underground passageways. In some examples, these may include passageways for the installation of cables or pipelines.

BACKGROUND

Smaller underground passageways for cables and pipes are generally created by first drilling a pilot hole with the use of a drill string. Once both the near and far ends of the pilot hole are open, a reamer is attached to the drill string, at either the near or far end. Then the reamer is forced along the length of the hole while spinning to enlarge it to the required diameter depending on the size of the pipe or cable to be installed. Several reamers of gradually increasing sizes may be used, depending on the required final diameter. A number of variations are possible, for instance, the reamer can be pushed through the hole (forward reaming) or drawn backwards through (back reaming). This use of a reamer may be known as a "hole opener" that enlarges an existing hole. In other examples, a reamer system may include a drill string lead by a drill bit and followed by a reamer to enlarge the hole created by the drill bit.

Underground reamers may include a cylindrical body that, in use, is connected to the drill string. The cylindrical body may have cutting wings that are welded onto the cylindrical body or bolted into recesses in the cylindrical body. While travelling through the hole, the reamer is rotated by the drill string. The rotation of the cutting wings against the underground formation enlarges the hole.

A problem with reamers with wings fixed by welding is that they cannot be easily repaired on site. Satisfactory repairs can only be undertaken in a well-equipped engineering workshop. This presents another difficulty in that it is extremely difficult to achieve the axial run out tolerances required in a fabrication process. Another problem is that the reamer may not be well stabilised in the hole. This causes vibration which can lead to the reamer binding in the hole and result in the loss of the reamer, drill string, and even abandonment of the hole.

As a result, some reamers utilise a stabilizing ring which is welded to the tips of the cutting wings. The stabilizing rings can join the cutting wings together to provide lateral stability to the wings and to smooth out rotation of the reamer in the hole. This can reduce instances of vibration and reduce stability. However, having a stabilizing ring welded to the wings removes the ease of replacing the cutting wings in the field. Therefore, repair and servicing may require the reamer to be returned to a workshop.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

A reamer for underground passageways, including a support housing, a plurality of radially extending cutting wings.

The reamer also includes a stabilization ring formed of a plurality of ring segments. Each ring segment includes an arcuate ring portion. When the plurality of ring segments are assembled to form the stabilization ring, the stabilization ring bridges the radial outer edges of the plurality of cutting wings. The stabilization ring is fastened to at least one of the cutting wings to resist radial movement of the wings relative to the reamer body. The stabilization ring, as part of the reamer may also function to keep the reamer substantially centred in the underground passageway, whereby the stabilization ring may contact the wall of the underground passage to resist radial movement of the reamer.

In some examples, each ring segment bridges the radial outer edges of two adjacent cutting wings. In some alternative examples, each ring segment is in contact with one adjacent cutting wing only, whereby the bridge between two adjacent cutting wings is formed by portions of ring segments assembled to each other.

In a further example, each ring segment further comprises: a first flange portion, wherein the first flange portion is located proximal to a first end of the arcuate ring portion, wherein the first flange portion extends substantially inwards towards a centre of the stabilization ring. Each ring segment may further comprises a second flange portion, wherein the second flange portion is located proximal to an opposite second end of the arcuate ring portion, wherein the second flange portion extends substantially inwards towards the centre of the stabilization ring.

The first and/or second flange portions may include at least one ring segment aperture and the cutting wing includes at least one ring fastening aperture wherein, when assembled, the at least one ring segment aperture and at least one ring fastening aperture receives a fastener.

The first and/or second flange portions may include a corresponding contact surface, wherein when assembled, the contact surfaces face a corresponding side surface of the cutting wing to transfer torsional forces between the stabilization ring and the cutting wings. The spaced apart pairs of adjacent first and second flange portions may have corresponding opposing contact surfaces to face and receive a respective cutting wing.

The ring segment may include extensions extending past respective junctions of the arcuate ring portion and the first and second flange portions. The cutting wing may include a recess to locate and receive the extensions of the ring segment. This arrangement of locating part of the ring segment in a recess of the cutting wing may assist resisting longitudinal forces on the stabilization ring during reaming.

The stabilization ring may comprise at least one groove on an outwardly facing surface of the stabilization ring. The at least one groove may extend between opposite front and back ends of the stabilization ring.

In some examples of the reamer, the plurality of ring segments include four ring segments to form the stabilization ring.

In some alternative examples of the reamer, the plurality of ring segments include five ring segments to form the stabilization ring.

In yet another example of the reamer, the plurality of ring segments include six ring segments to form the stabilization ring.

In yet other alternatives of the reamer, the plurality of ring segments may include two, three, seven, or eight ring segments to form the stabilization ring. It is to be appreciated that further examples may have more, such as nine ring segments, ten ring segments, etc.

In some examples, there is the same number of cutting wings to ring segments.

In some examples of the reamer, the support housing includes plural integral pairs of spaced apart radially extending support wings, wherein between each pair of support wings there is a longitudinally extending slot such that each cutting wing is received between a respective pair of support wings, wherein the cutting wings engage with the support housing to resist rearward longitudinal movement, and with the support wings to resist torsional forces between the cutting wings and the support housing.

There is also disclosed a ring segment a stabilization ring of an underground reamer. The ring segment including an arcuate ring portion extending between a first end and an opposite second end. In use, a plurality of arcuate ring portions are arranged end to end to form the stabilization ring, wherein the stabilization ring is fastened to other components of the reamer. The reamer may include the reamer described above having cutting wings. In some examples, the other components may include one or more cutting wings of the reamer. In further examples, the other components may include one or more of the support wings.

The ring segment may include a first flange portion wherein the first flange portion is located proximal to the first end of the arcuate ring portion, wherein the first flange portion extends substantially inwards towards a centre of the stabilization ring.

The ring segment may also include a second flange portion, wherein the second flange portion is located proximal to the second end of the arcuate ring portion, wherein the second flange portion extends substantially inwards towards the centre of the stabilization ring.

In some examples of the ring segment, the first and/or second flange portions include a least one ring segment aperture to receive a fastener for fastening the ring segment to other components of the reamer. The fasteners may receive some of the forces, to resist relative movement between components of the reamer, including radial movement and/or longitudinal movement along the longitudinal axis of the reamer.

In the ring segment, the first and/or second flange portions may include a corresponding contact surface, wherein when arranged to form the stabilization ring, the contact surface face a corresponding component side surface to transfer torsional forces between the stabilization ring and one or more other components of the reamer.

In some examples of the ring segment, when assembled to form the stabilization ring, spaced apart pairs of adjacent first and second flange portions have corresponding opposing surfaces to face and receive a respective other component of the reamer.

The ring segment may include extensions that extend past respective junctions of the arcuate ring portion and the first and second flange portions, wherein in use, the extensions are located and received in respective recesses of other components of the reamer.

The ring segment may further comprise at least one groove on an outwardly facing surface of the arcuate ring portion. The outwardly facing surface may be substantially convex. When the ring segments are arranged to form the stabilization ring, the at least one groove may extend between opposite front and back ends of the stabilization ring.

In some examples of the ring segment, the arcuate ring portion forms a one quarter segment of the stabilization ring.

In an alternative example of the ring segment, the arcuate ring portion forms a one fifth segment of the stabilization ring.

In yet another example of the ring segment, the arcuate ring portion forms a one sixth segment of the stabilization ring.

In yet further examples of the ring segment, the arcuate ring portion may form a one half, one third, one seventh, or one eighth, segment of the stabilization ring. It is to be appreciated the segments can include further fractions including one ninth, one tenth, 1/n, etc.

There is also disclosed a cutting wing for a reamer described above.

There is also disclosed a kit for a reamer comprising one or more ring segments and one or more cutting wings, wherein the ring segments and cutting wings are assembled with a support housing to form a reamer described above.

BRIEF DESCRIPTION OF DRAWINGS

Examples of the present disclosure will now be described with reference to.

DESCRIPTION OF EMBODIMENTS

Overview

Figure 6:
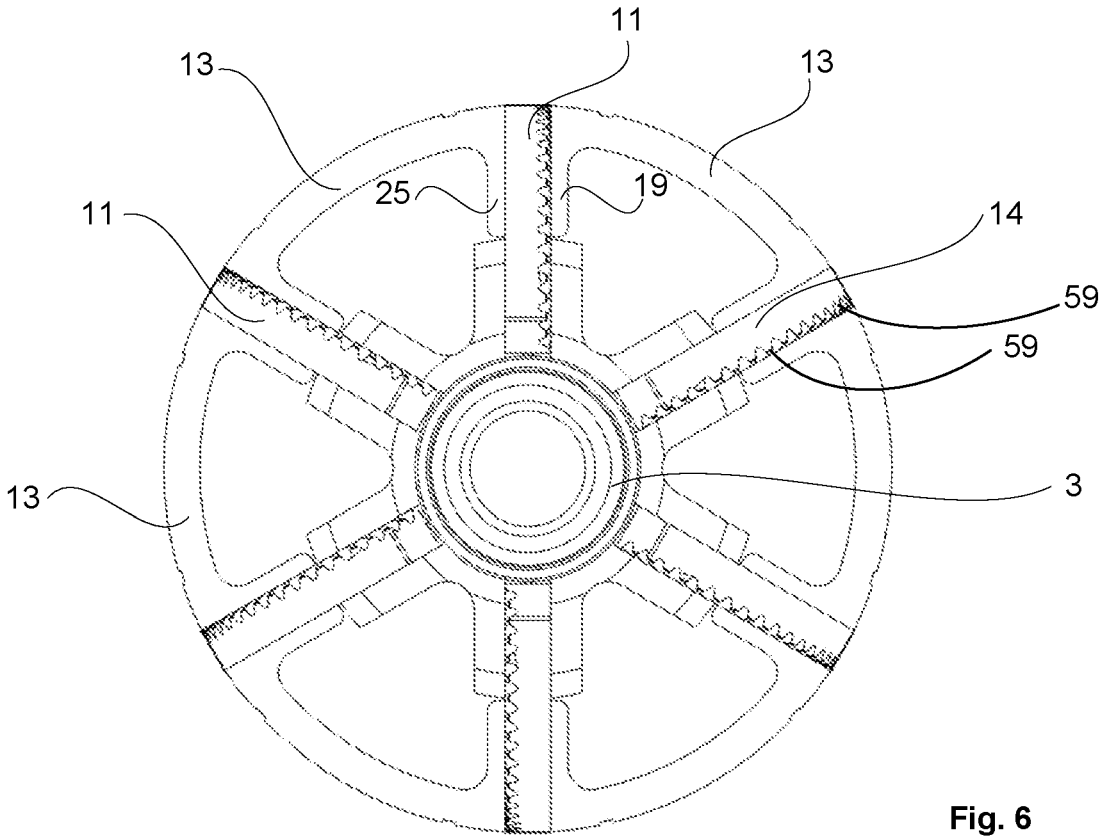
FIG. 6 is a front view of the reamer in FIG. 1.
Figure 7:
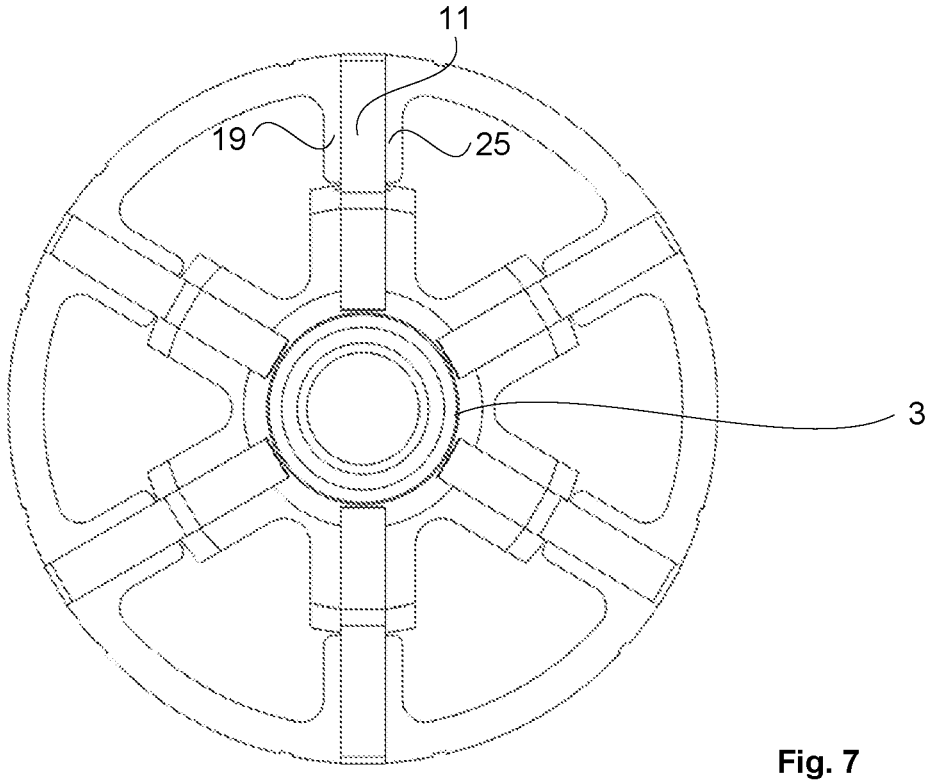
FIG. 7 is an end view of the reamer in FIG. 1.
Figure 8:
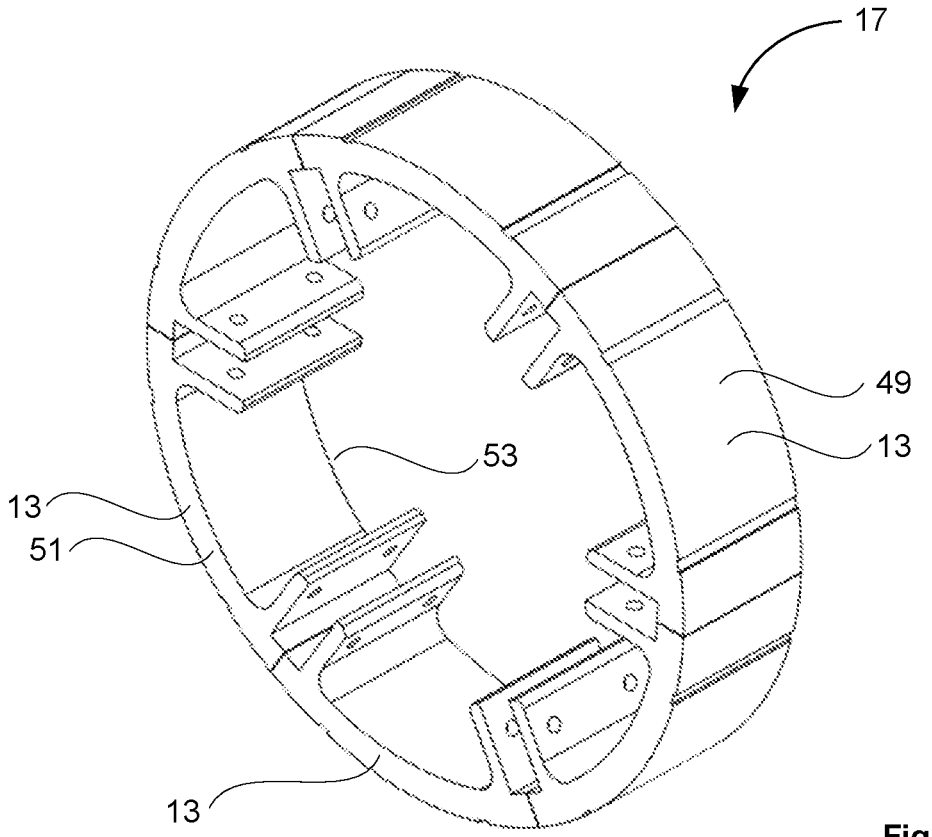
FIG. 8 is a perspective view of a stabilization ring for the reamer in FIG. 1.
Figure 9:
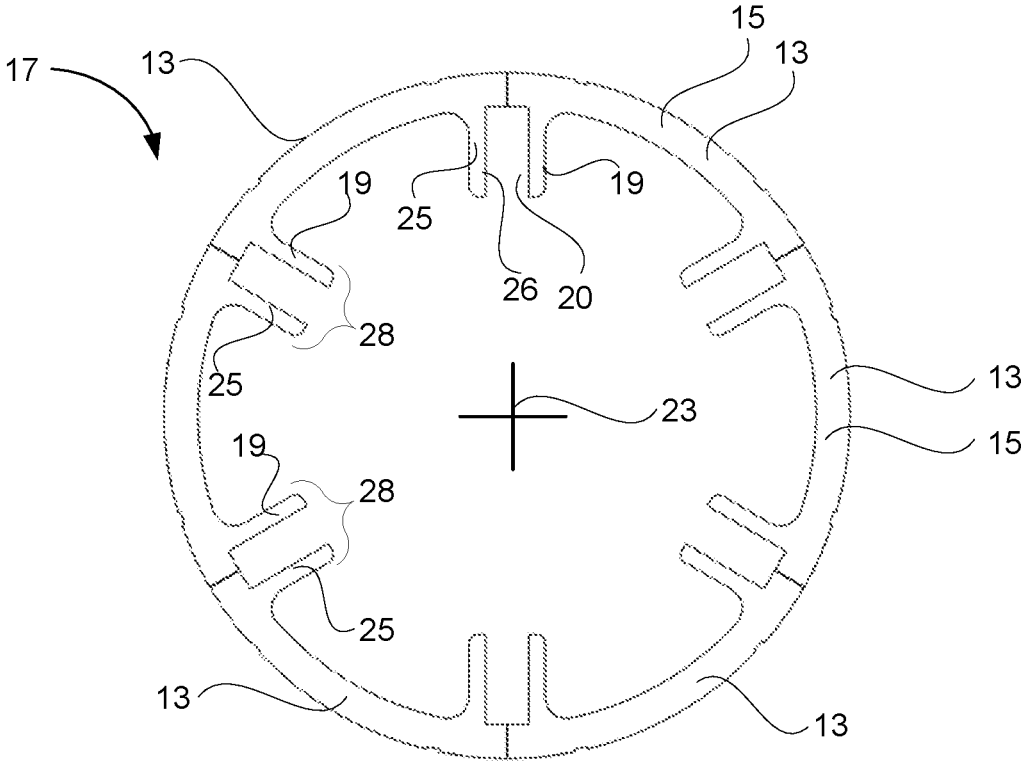
FIG. 9 is a front view of the stabilization ring in FIG. 8.
Figure 10:
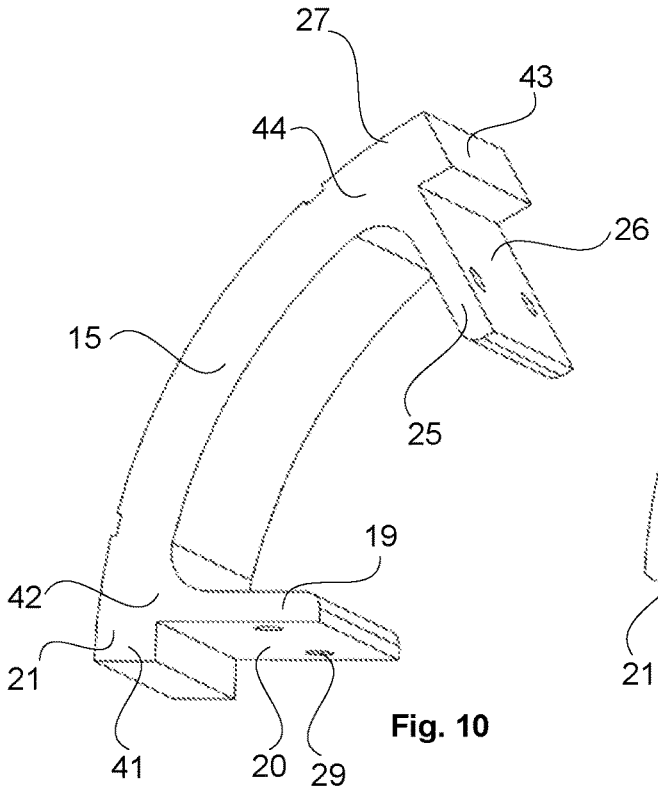
FIG. 10 is a view of a ring segment of the stabilization ring in FIG. 8
Figure 11:
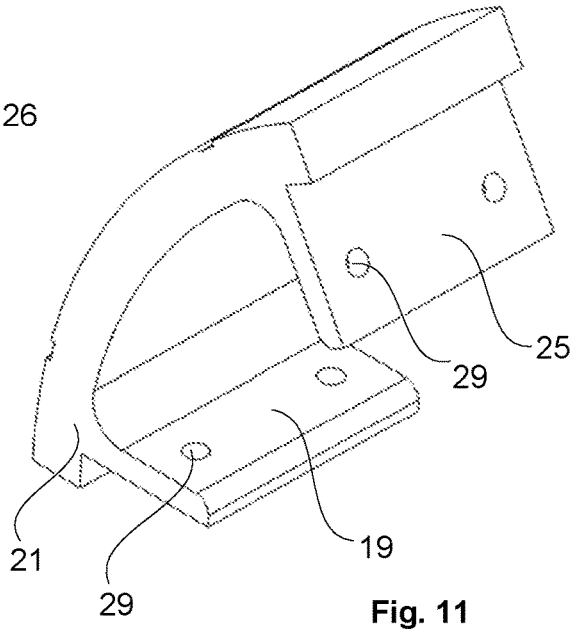
FIG. 11 is an alternative view of the ring segment in FIG. 10
Figure 12:
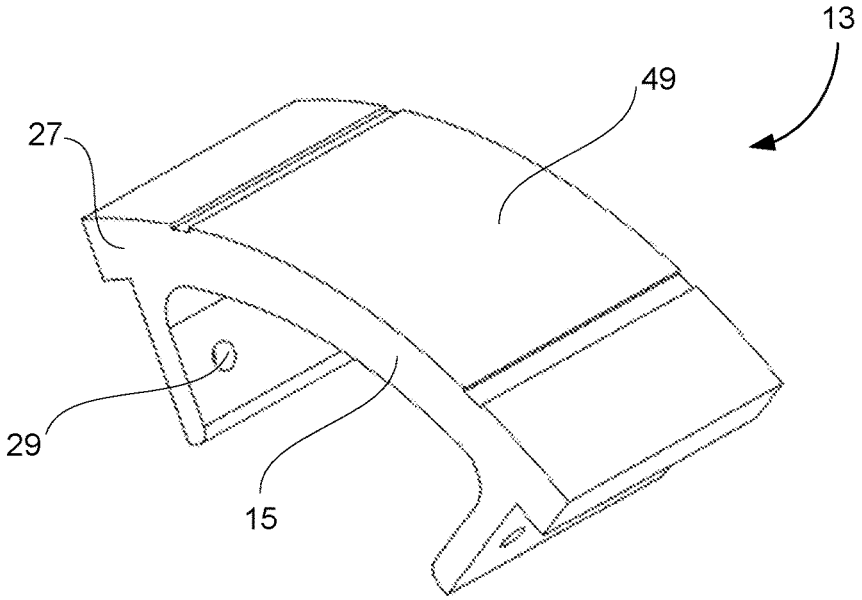
FIG. 12 is yet another view of the ring segment in FIG. 10.
Figure 16:
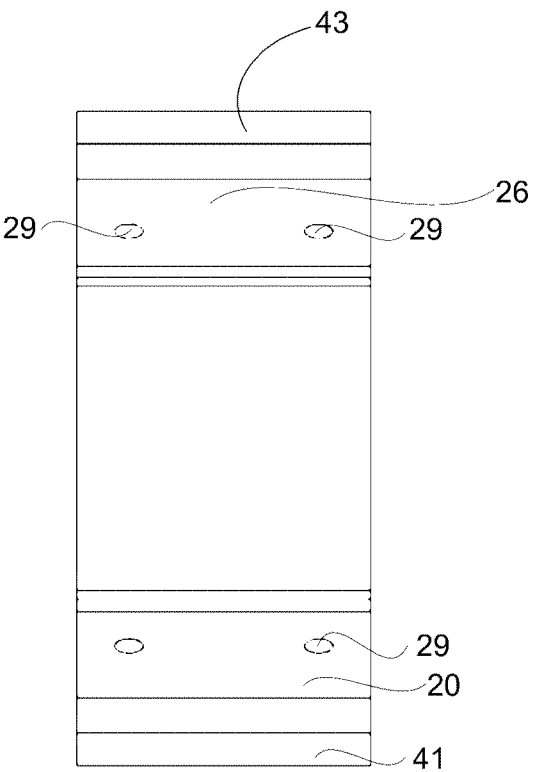
FIG. 16 is side view of an inside surface of the ring segment in FIG. 11.
Figure 13:
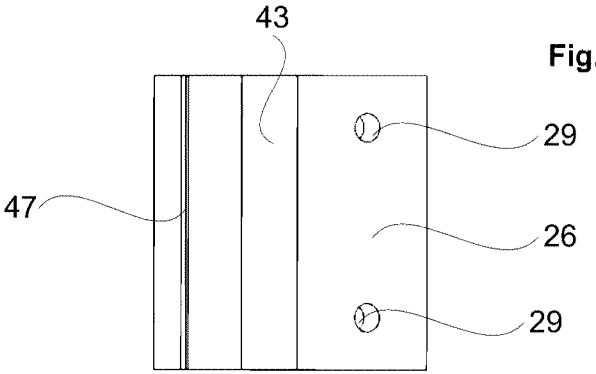
FIG. 13 is a top view of the ring segment in FIG. 11.
Figure 15:
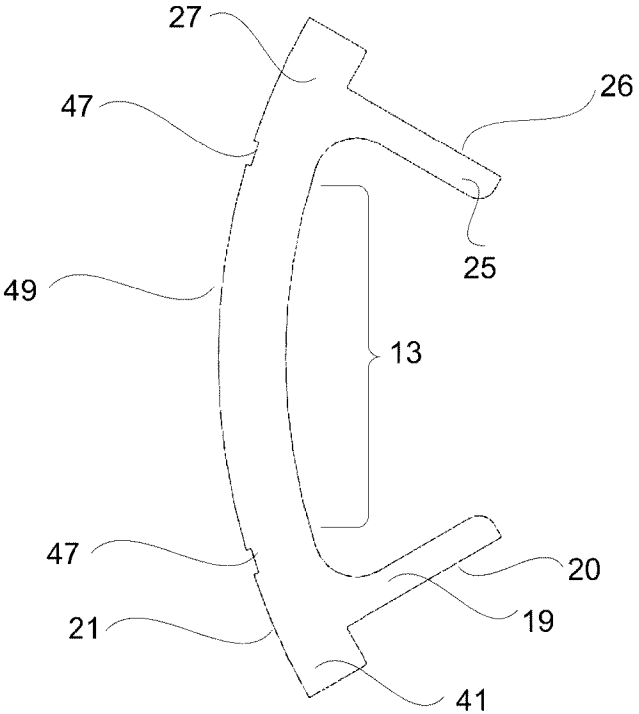
FIG. 15 is a front view of the ring segment in FIG. 11.
Figure 14:
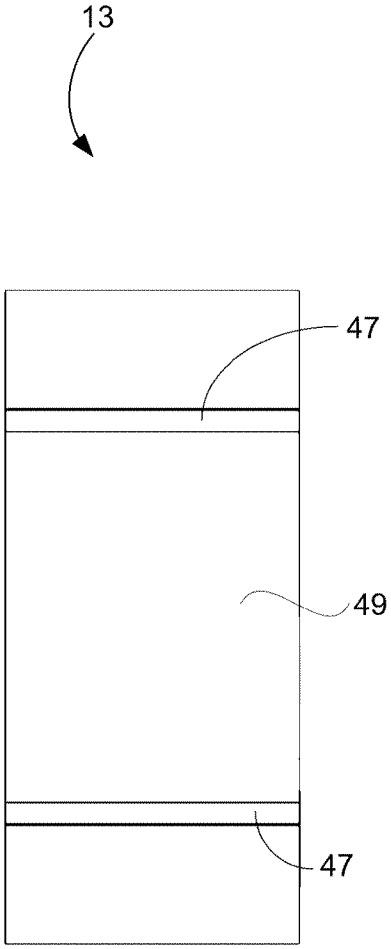
FIG. 14 is a side view of an outwardly facing surface of the ring segment in FIG. 11.
Figure 17:
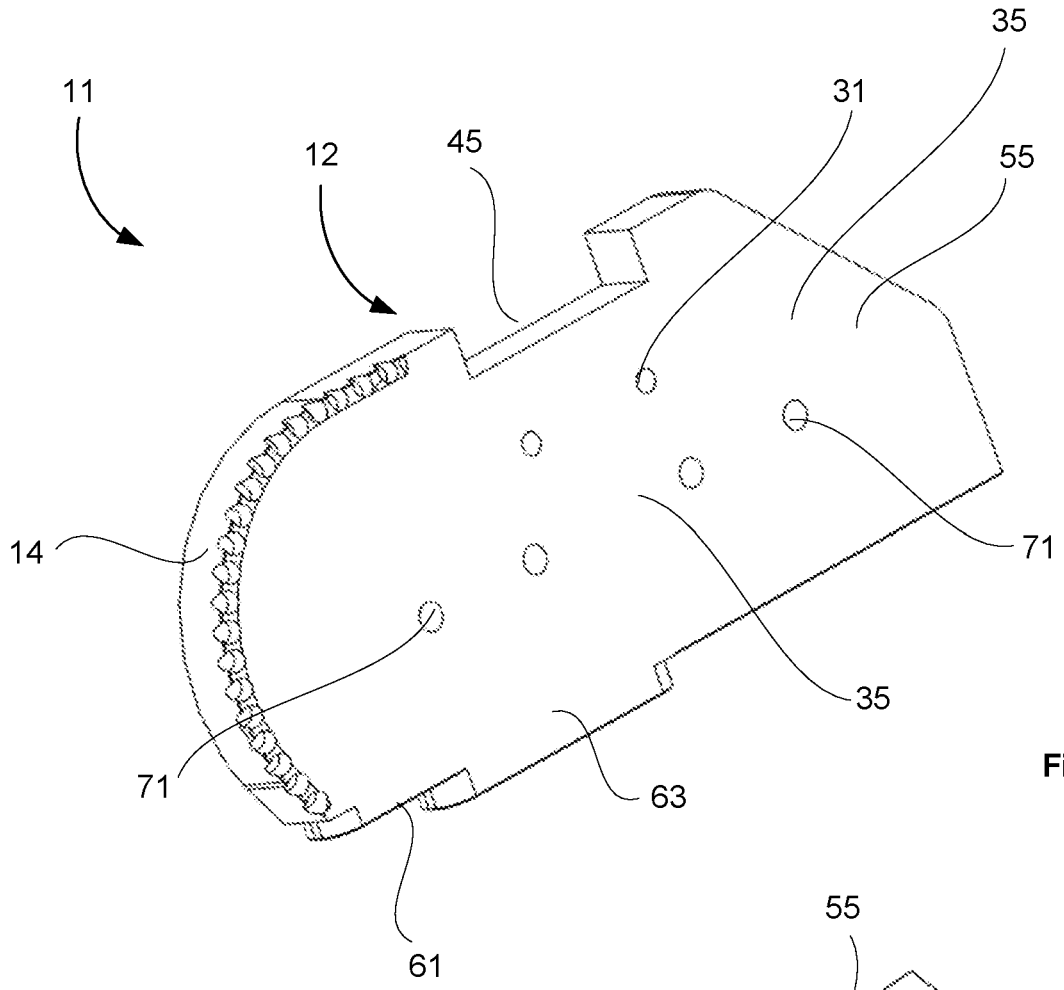
FIG. 17 is a top perspective view of a cutting wing for the reamer in FIG. 1.
Figure 18:
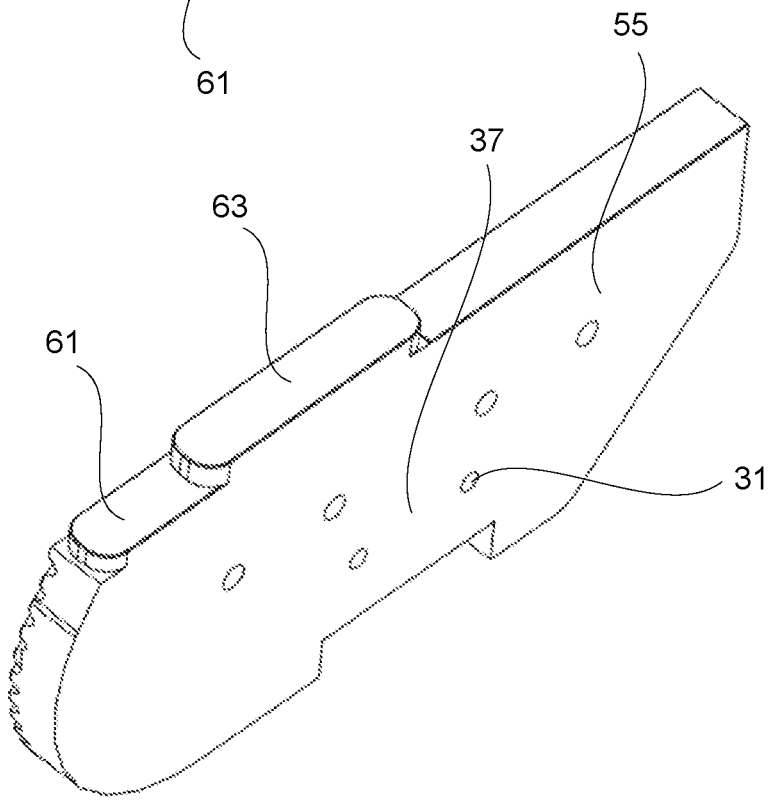
FIG. 18 is an alternative perspective view of the cutting wing in FIG. 17.
Figure 19:
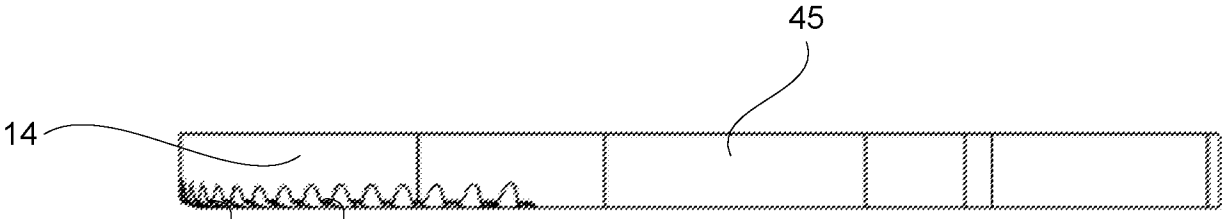
FIG. 19 is a top view of the cutting wing in FIG. 17.
Figure 21:
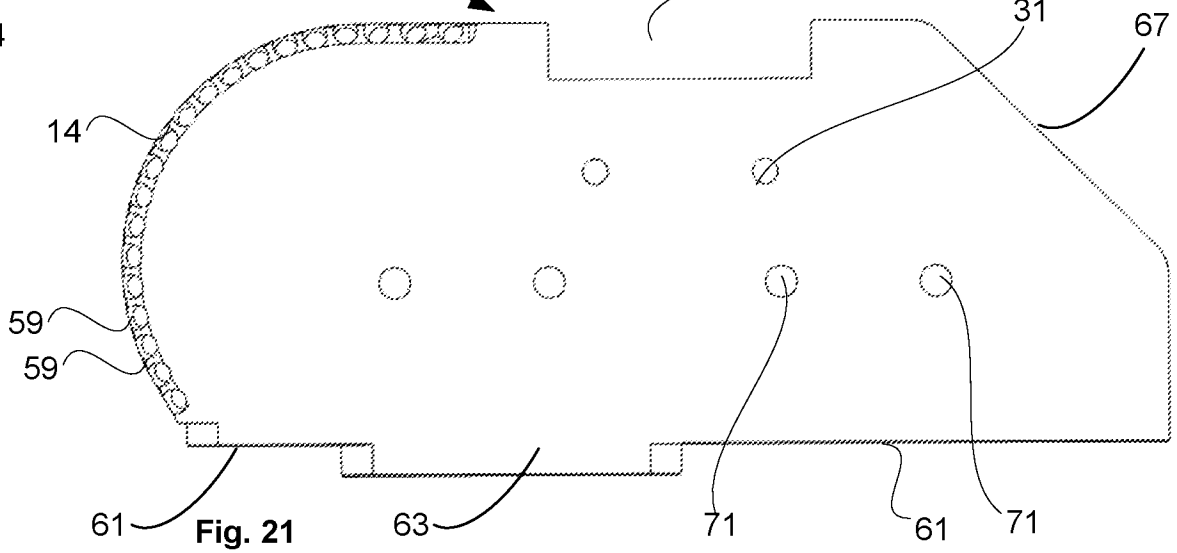
FIG. 21 is a side view of the cutting wing in FIG. 17.
Figure 20:
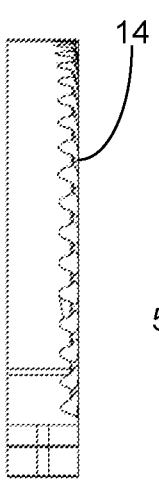
FIG. 20 is a front view of the cutting wing in FIG. 17.
Figure 22:
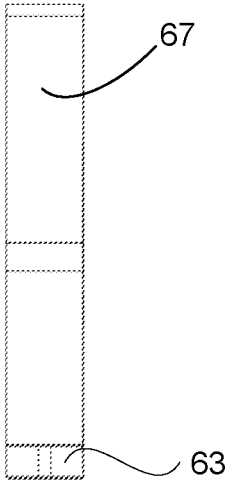
FIG. 22 is a rear view of the cutting wing in FIG. 17.
Figure 23:
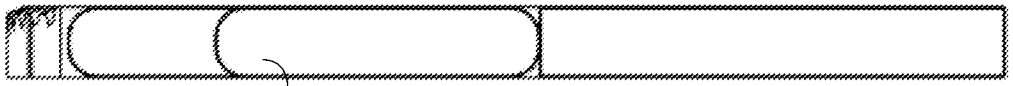
FIG. 23 is a bottom view of the cutting wing in FIG. 17.
Figure 25:
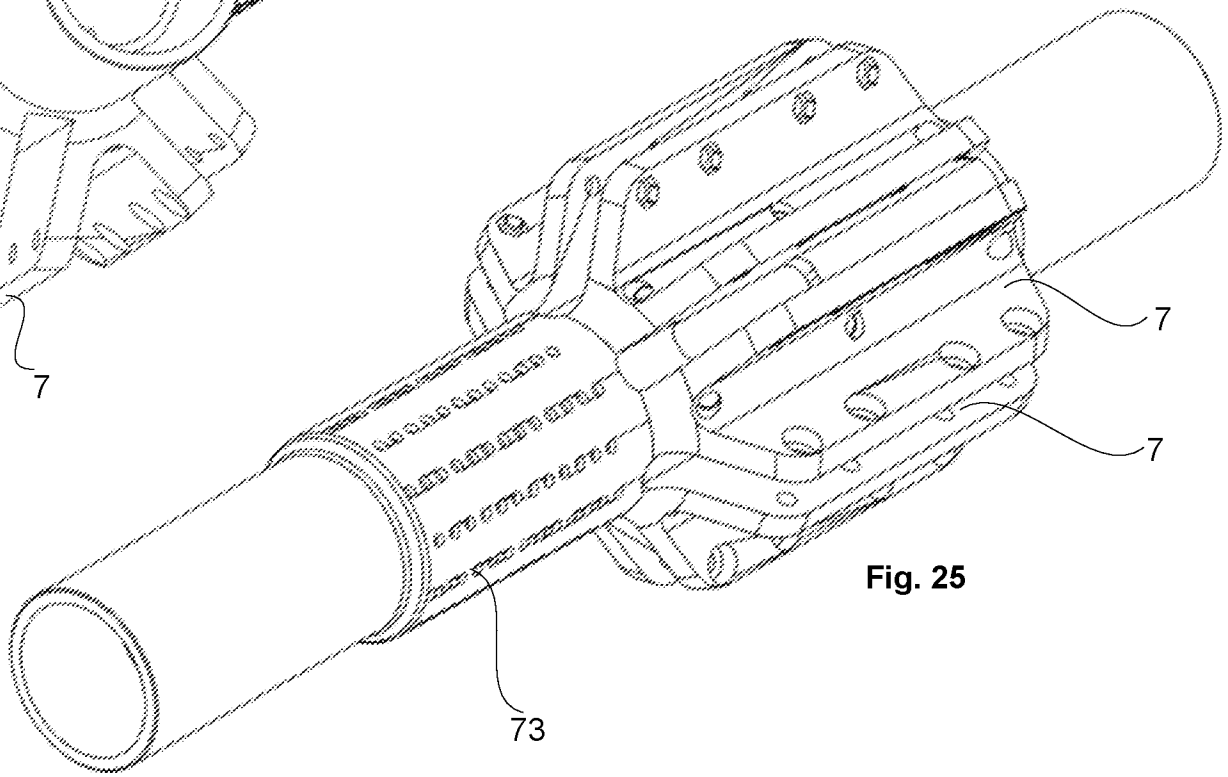
FIG. 25 is another perspective view of the support housing in FIG. 24.
Figure 24:
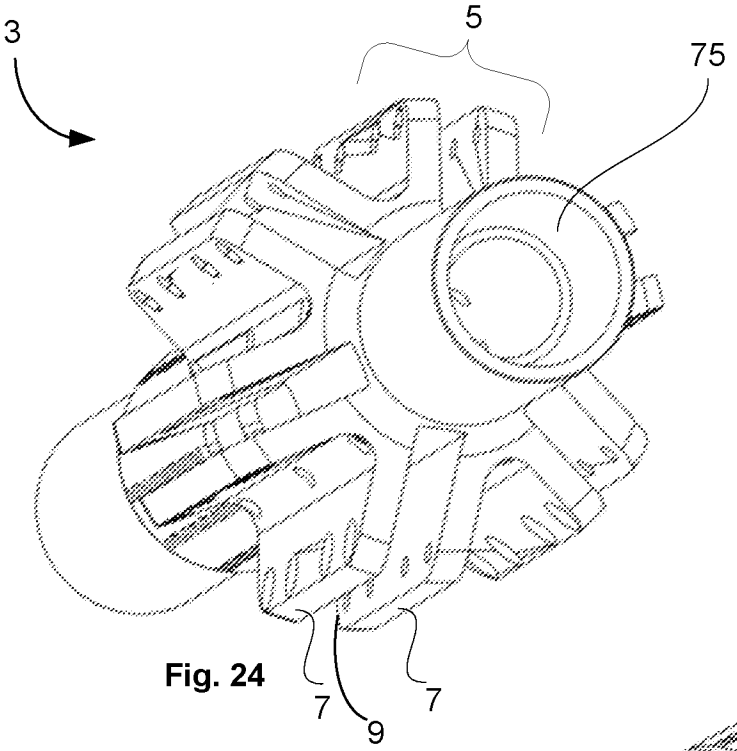
FIG. 24 is a perspective rear view of a support housing for the reamer in FIG. 1.

FIGS. 1 to 7 illustrate an example of a reamer 1 for use in creating underground passageways. The reamer 1 includes a support housing 3 and a plurality of radially extending cutting wings 11. The cutting wings 11 include a leading edge to ream the underground passageway. A stabilization ring 17 bridges outer edges 12 of the plurality of wings 11. The stabilization ring 17, as shown separately in FIGS. 8 and 9, is formed by assembling a plurality of ring segments 13, whereby each ring segment 13 includes an arcuate ring portion 15. The stabilization ring 17 is fastened to at least one of the cutting wings 11.

In use, the reamer 1 is attached to a drill string and passed through a pilot bore hole (which is smaller in diameter than the desired underground passageway). The cutting wings 11 rotate around a longitudinal axis of the support housing 3, which is usually coaxial with the axis of the drill sting, so that the leading edge 14 cuts the underground formation to create the reamed passageway. The stabilization ring 17 assists in resisting movement of the reamer 1 in directions radial to the longitudinal axis. That is, to keep the reamer 1 centred with the axis of the drill string and the underground passageway.

Figure 1:
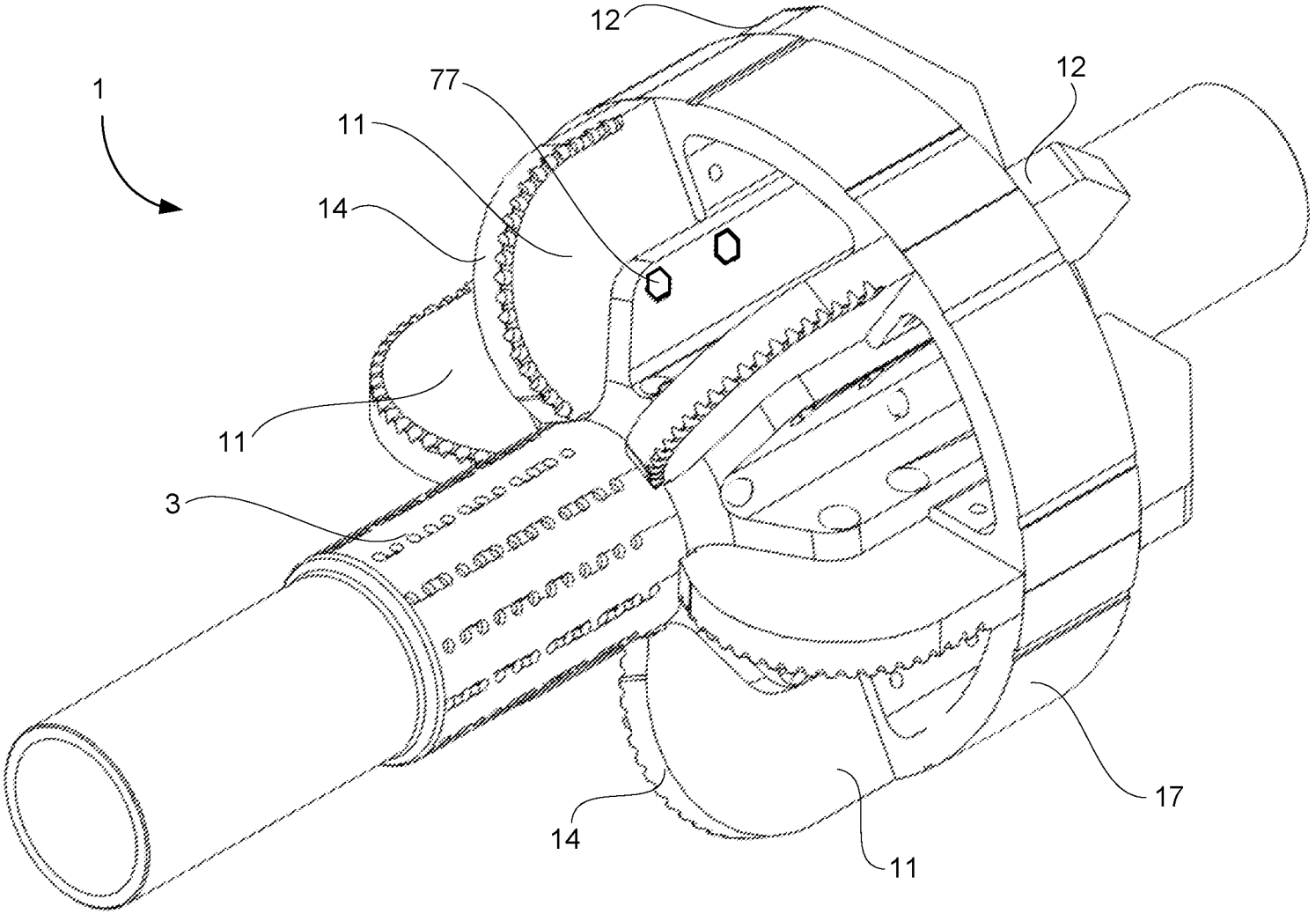
FIG. 1 is a perspective view of a reamer according to the present disclosure.
Figure 2:
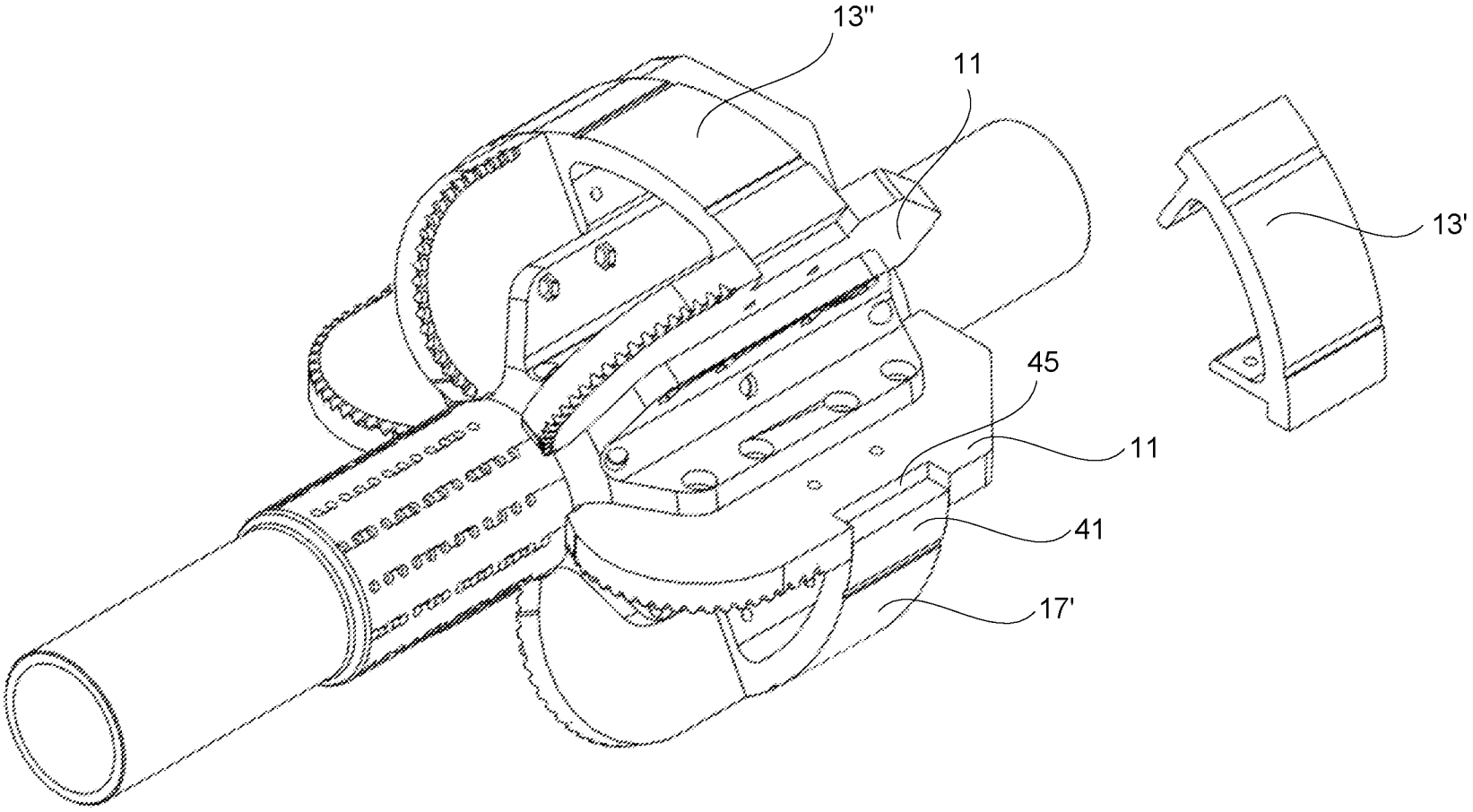
FIG. 2 is a perspective view of the reamer in FIG. 1 with a ring segment removed.
Figure 3:
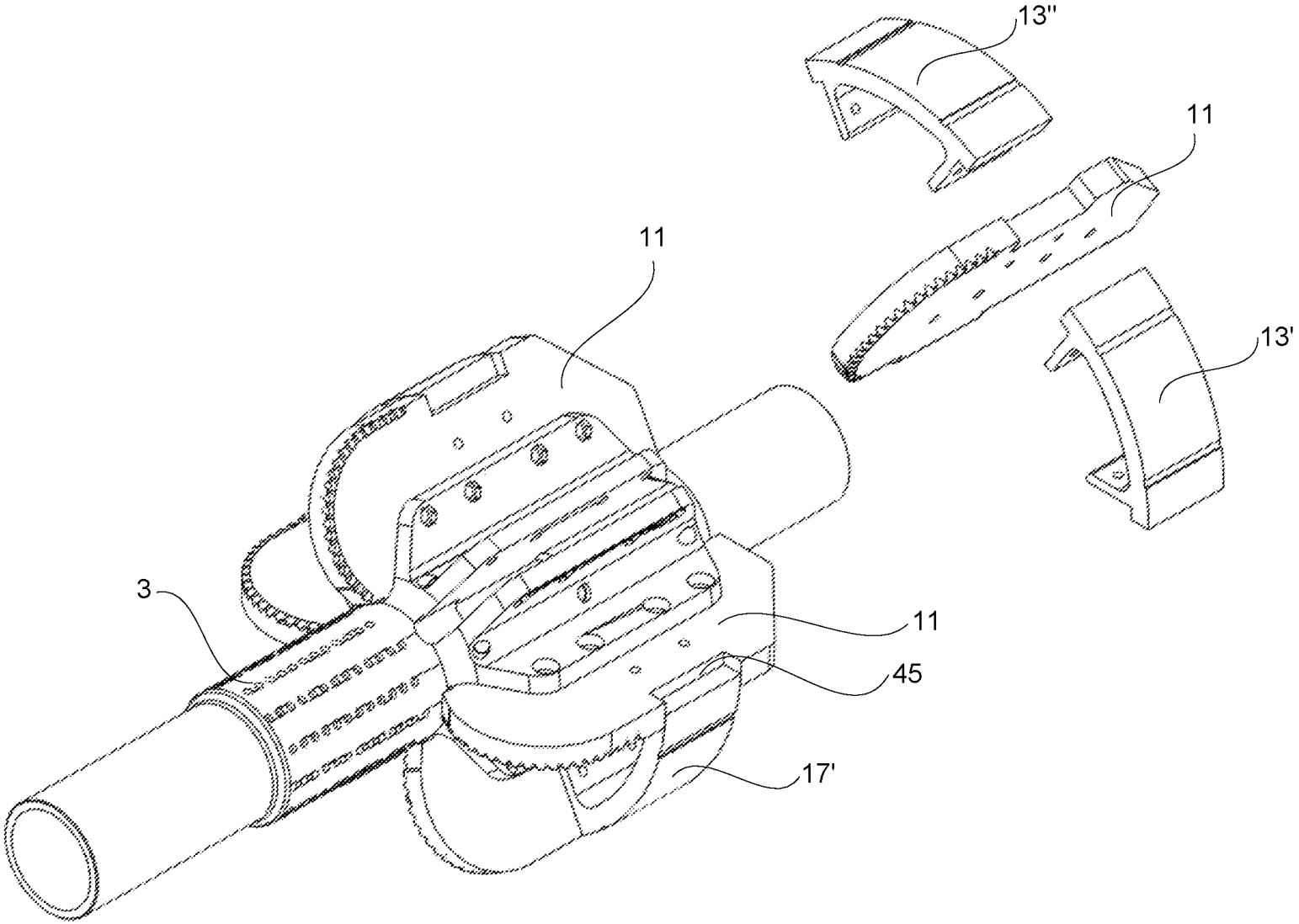
FIG. 3 is a perspective view of the reamer in FIG. 1 with two ring segments and a cutting wing removed.
Figure 4:
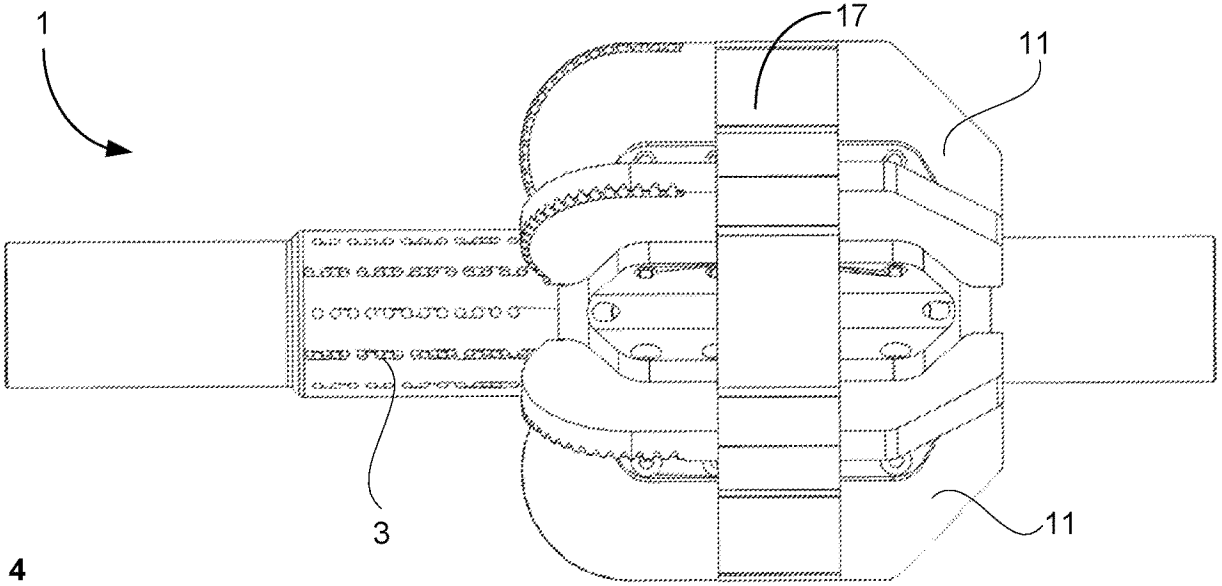
FIG. 4 is a top view of the reamer in FIG. 1.
Figure 5:
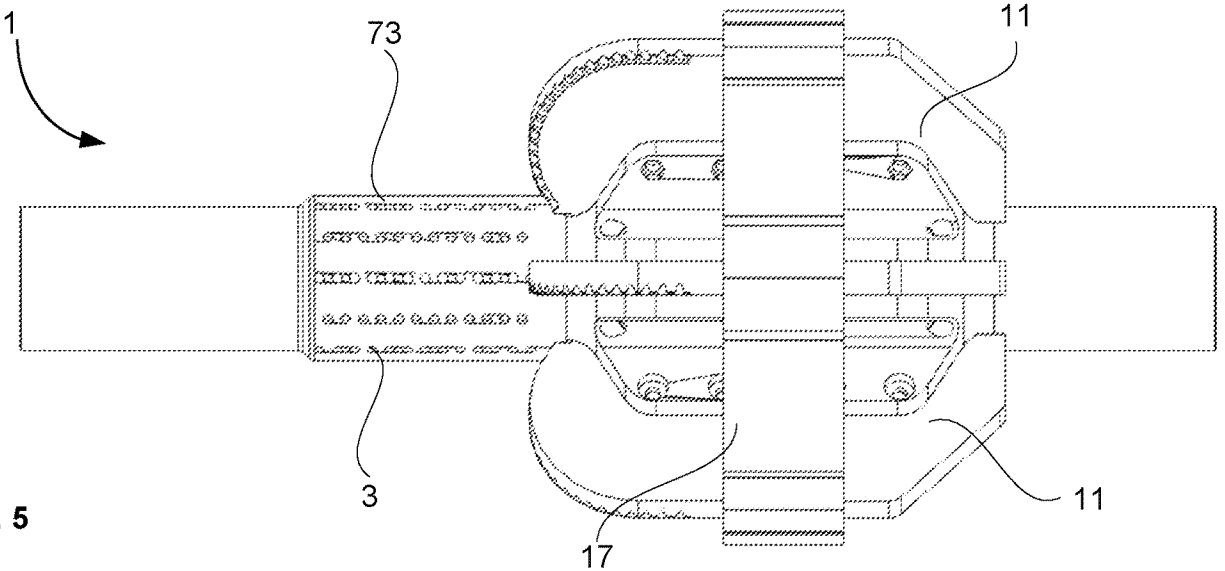
FIG. 5 is a side view of the reamer in FIG. 1.

Having the stabilization ring 17 formed from a plurality of ring segments 13, may advantageously assist assembly, disassembly, repair, maintenance and resizing of the reamer 1. Referring to FIG. 2, the reamer 1 may be disassembled by unfastening a ring segment 13' so that the ring segment 13' can be separated from the cutting wings 11 and the remaining portions of the stabilization ring 17'. Referring to FIG. 3, another ring segment 13" can also be unfastened and separated from the remaining portions of the stabilization ring 17'. This allows a cutting wing 11' to be separated from the support housing 3. This process can be repeated to remove further ring segments 13 and cutting wings 11. The reamer 1 may be assembled with these steps carried out in reverse.

This may assist removal and replacement of a worn or damaged ring segment 13 or cutting wing 11 without disassembling other serviceable components reamer 1. Additionally, this configuration may allow removal and replacement of the ring segment(s) 13 or cutting wing(s) 11 without breaking the drill string. For example, if an operator has side access to the reamer 1 inside an underground passageway, such as hole laterally connecting the passageway, the operator may unfasten and replace the problematic ring segment 13 and/or cutting wing 11 whilst leaving the remaining portions of the reamer 1 in situ. In particular, a stabilization ring that is unitary cannot be laterally removed from the drill string (as the ring will be looped around the drill string and support housing 3).

In addition, the above mentioned reamer 1 may also allow various sizes of cutting wings 11 and ring segments 13 to be easily changed. This may be particularly advantageous in cases where an underground passageway needs to be progressively reamed (i.e. from a smaller diameter hole to a larger diameter hole). In other examples, an underground passageway may require differing diameters along the length of the passageway. The presently described reamer 1 may allow easy change of the diameter of the reamer 1 whilst keeping the support housing 3 in place on the drill string. This may be in contrast to some other reamers where changing the size of the reamer would require retracting and breaking the drill string to change components of the reamer that adds time and labour.

Components of the reamer 1 will now be described in further detail.

The Ring Segment 13

FIGS. 10 to 16 illustrate various views of an example of a ring segment 13. This includes a ring segment 13 configured such that six of these ring segments can be assembled to form a stabilization ring 17 (as shown in FIGS. 8 and 9).

The ring segment 13 has an arcuate ring portion 15 that has a curved outwardly facing surface 49 between a first end 21 and an opposite second end 27. The arcuate ring portion 15, in this example, spans a one sixth of the stabilization ring 17 and therefore is equivalent to approximately sixty degrees. It is to be appreciated that in other examples, more or less ring segments 13 may form the stabilization ring 17 and have different dimensions which will be discussed in the variations section below.

The arcuate ring portion 15 may bridge the radial outer edges 12 of two adjacent cutting wings 11, whereby the first end 21 is located proximal to the outer edge 12 of one cutting wing 11 and the second end 27 is located proximal to the outer edge 12 of another cutting wing 11.

A first flange portion 19 may extend from the arcuate ring portion 15 such that, when assembled, the first flange portion 19 extends substantially inwards towards a centre 23 of the stabilization ring 17. The first flange portion 19 may be proximal to the first end 21 so that a first contact surface 20 of the first flange portion 19, when the reamer 1 is assembled, is in contact with a corresponding side surface 35 of the cutting wing 11. Such an abutment of the first contact surface 20 and the corresponding side surface 35 can assist in the transfer of torsional forces between the stabilization ring 17 and the cutting wings 11. In some examples, the first contact surface 20 and corresponding side surface 35 may include substantially flat planar portions, wherein the planar portion is on a plane that passes close to, or through, the longitudinal axis of the support housing 3. This may be advantageous in transferring moment/torsion, from the stabilization ring 17 to the cutting wing 11.

A second flange portion 25 may extend from the arcuate ring portion 15. This second flange portion 25 may be proximal to the second end 27 of the arcuate ring portion and also extend substantially inwards towards the centre 23 of the stabilization ring 17. The second flange portion may have a second contact surface 26 to face a corresponding side surface 37 of the cutting wing 11, similar to the first flange portion 19. In the illustrated example, the first and second contact surfaces 20, 26 are substantially planar to abut with corresponding side surfaces 35, 37. However, it is to be appreciated that the contact surfaces 20, 26 and side surfaces 35, 37 may have corresponding non-planar features such as ridges and grooves to match with one another. This may assist locating of the ring segment 13 relative to the cutting wing 11 during assembly as well as assisting in maintaining the components to one another.

The first and second flange portions 19, 25 may have one or more ring segment apertures 29. These may receive fasteners so that the ring segment 13 can be fastened to other components of the reamer 1. In some examples, the ring segment apertures 29 are used to assist fastening of the ring segment 13 to a cutting wing 11. In other examples, the ring segment apertures 29 are used to assist fastening of a ring segment 13 to an adjacent ring segment 13. In the illustrated example, a fastener can pass through the ring segment aperture 29 of adjacent ring segments 13 as well apertures 31 in the cutting wing 11 to fasten the three components to each other. In some examples, some of the forces are transmitted from the flange portions 19, 25 to other components of the reamer 1 via the fasteners (and corresponding aperture walls of the components).

The ring segment 13 may further include extensions 41, 43 extending past respective junctions 42, 44 of the arcuate ring portion 15 and the first and second flange portions 19, 25. The extensions 41, 43 can extend into a recess 45 of the cutting wing 11. This can assist indexing of the parts during assembly. In addition, the extensions 41, 43 may engage the recess 45 of the cutting wing 11 to resist relative movement of the stabilization ring 17 and the cutting wings 11 along the longitudinal axis of the support housing 3.

The ring segment 13 may also include at least one groove 47 on the outwardly facing surface 49. The at least one groove 47 provides a relief to allow fluid and small debris to pass through to reduce potential suction between the wall of the reamed passageway on the outwardly facing surface 49. This may assist ease of rotation of the reamer 1 in the passageway and well as movement of the reamer 1 through the passageway. In some examples the groove 47 extends between opposite front and back ends 51, 53 of the stabilization ring 17.

The Stabilization Ring 17

FIGS. 8 and 9 illustrate an example of a stabilization ring 17 that is formed by assembling six ring segments 13. When the ring segments 13 are assembled, a first flange portion 19 of one ring segment 13 form a spaced apart pair 28 with a second flange portion 25 of an adjacent ring segment 13. These spaced apart pairs 28 of adjacent first and second flange portions 19, 25 have their corresponding contact surfaces 20, 26 opposing each other so that they can face and receive a cutting wing 11 in between (as shown in FIGS. 6 and 7).

By having the first and second flange portions 19, 25 extending towards the centre, this increases the surfaces area for the flange portions to transfer force to the cutting wing 11. This arrangement also allows efficient transfer of the moment (i.e. torque when the entire stabilization ring 17 is considered) between the stabilization ring 17 and the cutting wing 17. This may provide less stress on components compared to, for example, an alternative system where the stabilisation ring is solely engaged with the outer edges 12 of the cutting wing 11.

When assembled, the stabilization ring 17 may have an outwardly facing surface 49 that is substantially continuous (i.e. similar to a continuous outer side wall of a cylinder). The even outwardly facing surface 49 may assist in centering the reamer 1 during reaming operations. This may also assist smooth extraction of the reamer 1 when it pulled back through the reamed passageway (i.e. the reverse direction from reaming).

In further examples, the ring segments 13 may be sized so that when assembled there is a small gap between adjacent ring segments 13. For example, there may be a gap of 1 millimetre between the extension 41 of one ring segment and the extension 43 of an adjacent ring segment 13. This gap may allow some flex and distortion during reaming. One advantage is that the gap may prevent, or reduce, transfer of torsional force from one ring segment 13 to an adjacent ring segment 13. Instead, this arrangement may allow all, or a substantial portion, of the torsional forces to be taken by the cutting wing 11 via the first or second flange portions 19, 25. In turn, this may reduce stress on the fasteners that fasten the ring segments 13 to the cutting wing 11.

In the illustrated example, the edge at the front end 51 and opposite back end 53 of the stabilization ring 17 (see FIG. 8) is a substantially smooth edge. However in some alternative examples, the edge(s) may include one or more cutting elements. This may provide secondary cutting (with primary cutting performed by the cutting wings 17). This secondary cutting may be useful to cut dislodged rock and soil from the formation to assist reaming and extraction.

In some examples, the stabilization ring 17 may by symmetrical so that either the front end 51 or back end 53 may be used and directed forwards during reaming. In turn, this may include symmetrical ring segments 13 that can be assembled in either direction. In some examples, this may also allow ring segments 13 to be reversed so that if the leading edge has wear, or minor damage, the ring segment 13 can be reconfigured so that the worn edge becomes the trailing edge.

The Cutting Wing 11

FIGS. 17 to 23 illustrate an example of a cutting wing 11. The cutting wing 11 includes a substantially planar body 55 with opposite side surfaces 35, 37. When assembled, the outer edge 12 extends towards the stabilization ring 17 and an inner edge 61 is located proximal to the longitudinal axis of the support housing 3.

Between the inner edge 61 and the outer edge 12, there is a leading edge 14 to cut the underground formation during reaming operations. The leading may be curved and include multiple cutting elements 59. The cutting elements can include hardened materials such as polycrystalline diamond cutters (PDC). The cutting elements are distributed along the leading edge 44 so that in use, they have a sweep that covers the surface to be reamed. In some examples, cutting wings 11 have replaceable cutting elements 59.

The outer edge 12 is substantially straight to follow the longitudinal walls of a reamed passageway. Portions of the outer edge 12 may include cutting elements 59 to ensure the reamed diameter is sufficient to allow the remaining portions of the reamer 1, such as the stabilization ring 17, to pass though without binding. The outer edge 12 may also include a recess 45. The recess 45 may locate and receive the stabilization ring 17 to aid locating of the ring segment(s) 13 during assembly. As shown in FIG. 2, this may include the recess 45 receiving the extensions 41, 43 of the ring segments 13. In addition, this configuration of the recess 45 also assists in resisting forces in the longitudinal direction between the stabilization ring 17 and the cutting wing 11.

The recess 45 may be configured so that the outer edge 12 and the stabilization ring 17 have a smooth and continuous transition (i.e. the outer radius of the stabilization ring 17 is the same at the outer edge 12 of the cutting wing 11). This may minimise irregularities that may cause the reamer 1 to be misdirected during reaming.

The inner edge 61 includes a key 63 to be received in a corresponding socket 65 in the support housing 3. This assists in location during assembly as well as resisting longitudinal forces between the cutting wing 11 and the support housing 3.

A trailing edge 67 may include a taper to assist centering and easy extraction of the reamer 1 when pulled back through the passageway.

The cutting wing 11 includes a plurality of fastener apertures 31, 71. Ring fastening apertures 31 are used to fasten the cutting wing 11 to the stabilization ring 17. Support body fastening apertures 71 may be used with fasteners to fasten the cutting wing 11 to the support body 3.

The Support Housing 3 and Configuring the Reamer for Use

The same support housing 3 may be configured for different diameters. This may involve selecting and assembling cutting wings 11 and ring segments 13 to provide the desired diameter.

Figure 26:
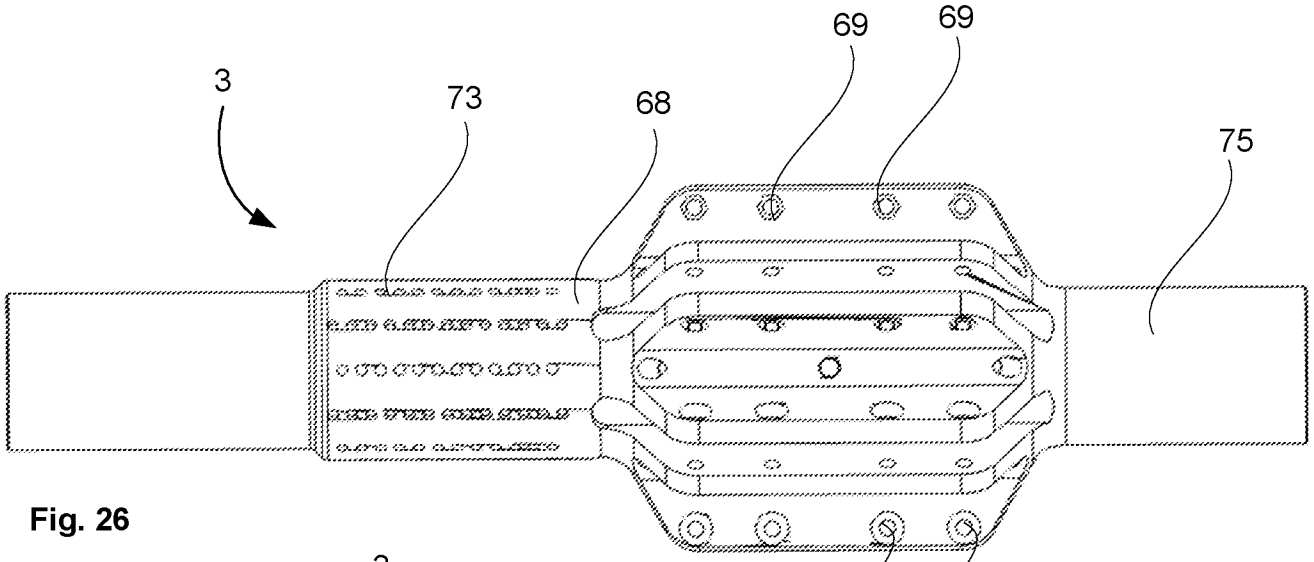
FIG. 26 is a top view of the support housing in FIG. 24.
Figure 28:
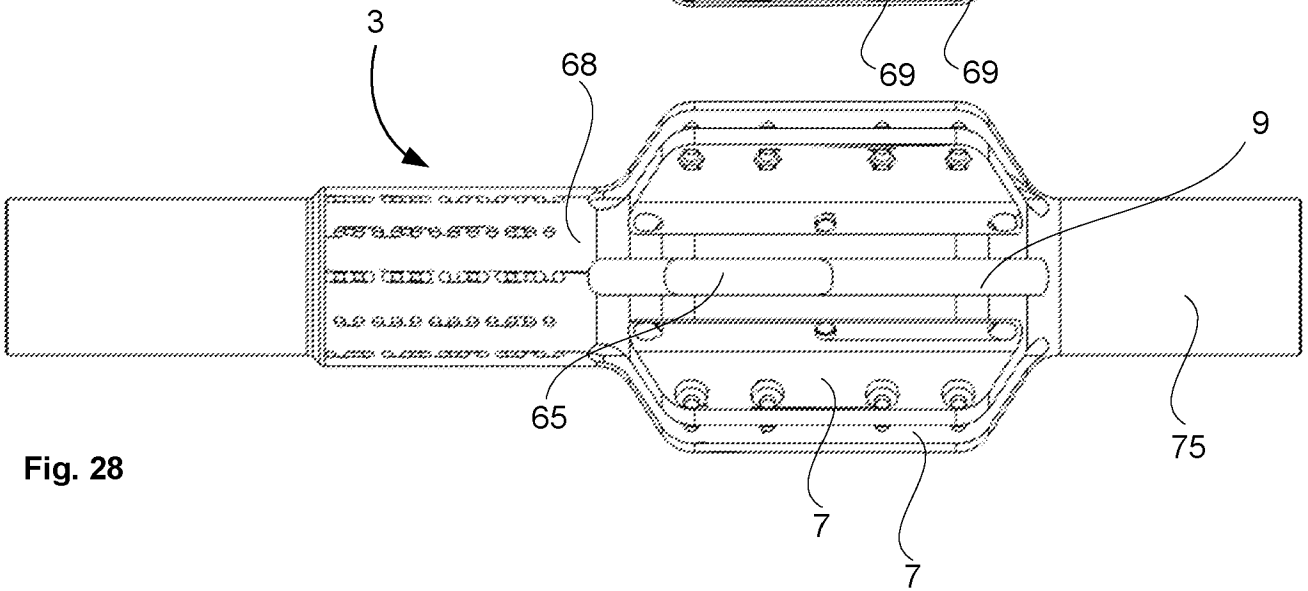
FIG. 28 is a side view of the support housing in FIG. 24.
Figure 27:
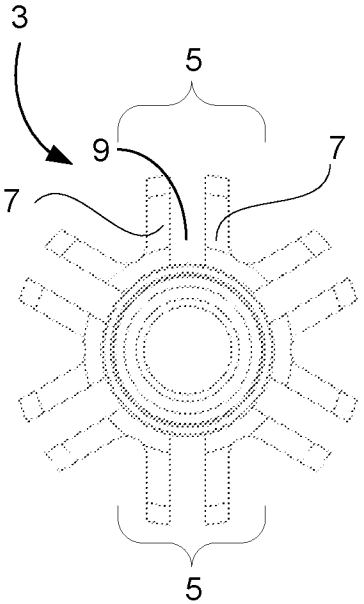
FIG. 27 is a front view of the support housing in FIG. 24.

Referring to FIGS. 26 to 27, the support housing 3 includes a body 68 and multiple pairs 5 of spaced apart support wings 7 that extend radially. Each pair 5 of support wings 7 includes a longitudinal slot 9 to receive the cutting wing 11. The support wings 7 assists in resisting torsional forces between the cutting wings 11 and the support housing 3.

The slots 9 also include a socket 65 to receive and engage with the key of the cutting wing 11. This engagement, at least in part, assists with resisting relative longitudinal movement between the cutting wing 11 and support housing 3.

To provide additional security, the support wings 7 include apertures 69 that match apertures 71 in the cutting wing 11. A fastener can be passed through the apertures 69, 71 to secure the two components to each other.

Once the cutting wings 11 are secured, the ring segments 13 may be located over the cutting wings 11 as illustrated in FIGS. 2 and 3. The ring segments 13 are then secured to the cutting wings 11 with additional fasteners.

An end 75 of the support housing 3 is connected to a drill string so that the reamer 1 can be introduced though a pilot borehole such that is reamed to the desired size of the underground passageway. In use the reamer 1 is rotated so that the cutting wings 11 engage the underground formation. Referring to the example in FIG. 1 the cutting inserts are positioned towards one side of the reamer 1 such that as the reamer 1 moves down the borehole, the reamer 1 should be rotated in an anticlockwise (counter clockwise) direction. Drilling fluid may be introduced through apertures 73 during reaming operations.

To change the size of the reamer 1 or to replace a broken part, the reamer may be pulled back through the reamed passageway to the top of the drill string or the reamer may be moved to a location that is accessible to an operator. The fasteners may then be removed, first to remove the ring segments 13 and then the cutting wings 11. It is to be appreciated that an operator may wish to remove them in groups (e.g. ring segments 13 and cutting wings 11 from one side, then the other side). New sizes of cutting wings 11 and ring segments 13 can then be installed. An advantage of this process is that the drill string does not necessarily need to be broken to change sizes and to replace parts.

The fasteners 77 may include bolts, bolt and nut combination, pins, etc. In some examples, the apertures may be stepped with enlarged recesses (see, for example, recesses 69 in the support body 3). This reduces the exposure to damage to parts of the fastener (such as the nut or head of the bolt). It is to be appreciated that during use, some torsional, radial, and longitudinal forces may be transmitted through such fasteners.

In some examples, the diameters may range from approximately 18 inches to 60 inches. In some examples the support housing may be designed for particular ranges of reamers. For example, a particular support housing may accommodate diameters of between 16 to 22 inches, whereas support housing may accommodate diameters of between 18 to 24 inches.

A kit, including ring segments 13 and cutting wings 11 may be supplied for each diameter or range of diameters. In other examples, the cutting wings 11 and ring segments 13 may be adapted to be used with existing support housings. Therefore, a kit including ring segments 13 and cutting wings 11 to upgrade existing reamers.

The components of the reamer 1, such as the support housing 3, cutting wing 11, and stabilization ring 17 may be made of metals and alloy thereof. In some examples, this includes steel, stainless steel, iron, aluminium, etc.

Variations

Number of Cutting Wings and Ring Segments

It is to be appreciated that different numbers of cutting wings 11 and ring segments 13 may be used. This may include combinations of:

two cutting wings and two ring segments;
three cutting wings and three ring segments;
four cutting wings and four ring segments;
five cutting wings and five ring segments;
seven cutting wings and seven ring segments; and
eight cutting wings and eight ring segments.

Figure 29:
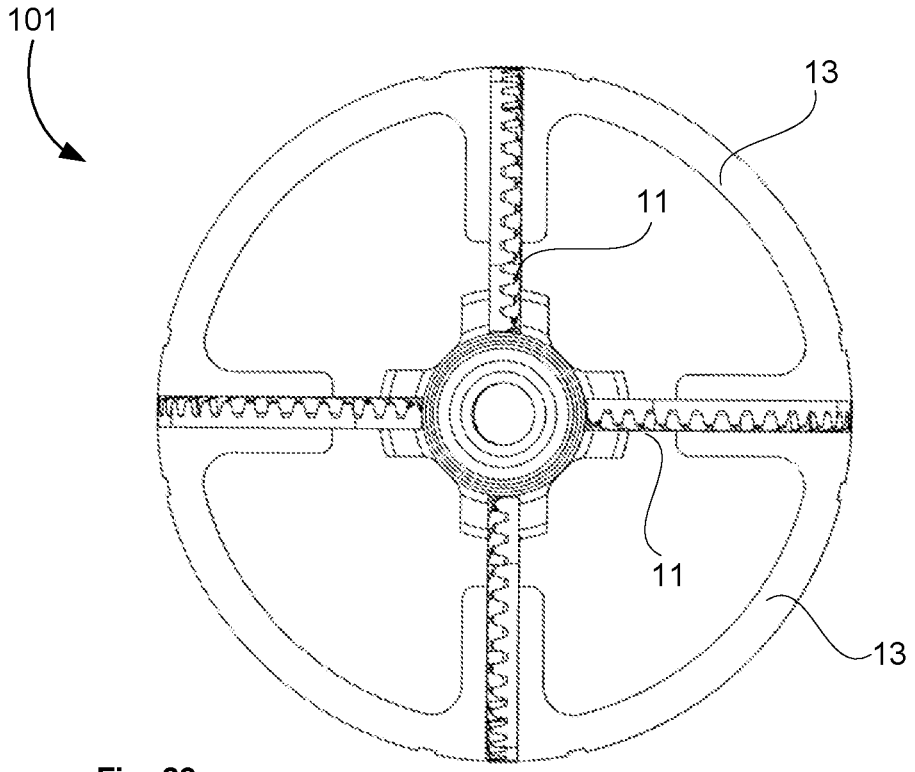
FIG. 29 is a front view of an alternative reamer with four cutting wings and four ring segments.
Figure 30:
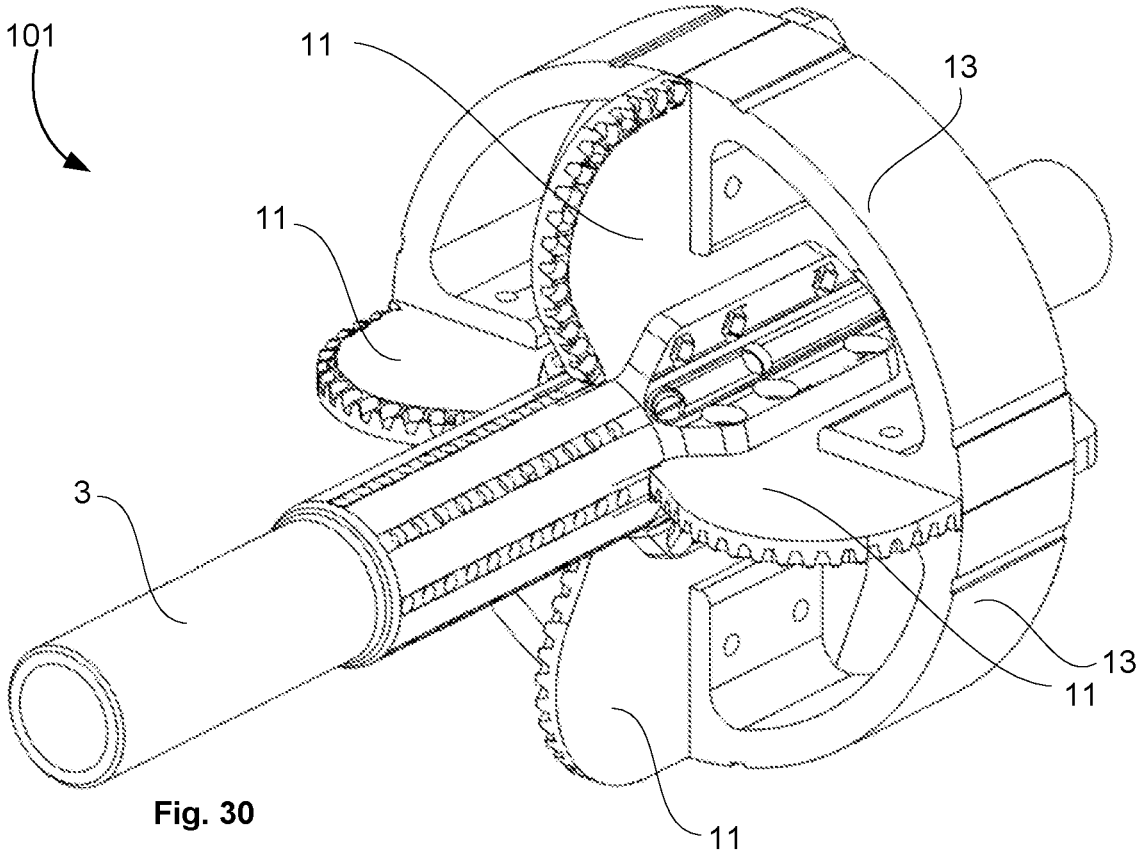
FIG. 30 is a perspective view of the reamer in FIG. 29.

FIGS. 29 and 30 illustrate an example of a reamer 101 with four ring segments 13 and four cutting wings 11. Each of the four ring segments 13 represent one quarter (i.e. 90 degrees) of the complete stabilization ring 17.

Figure 31:
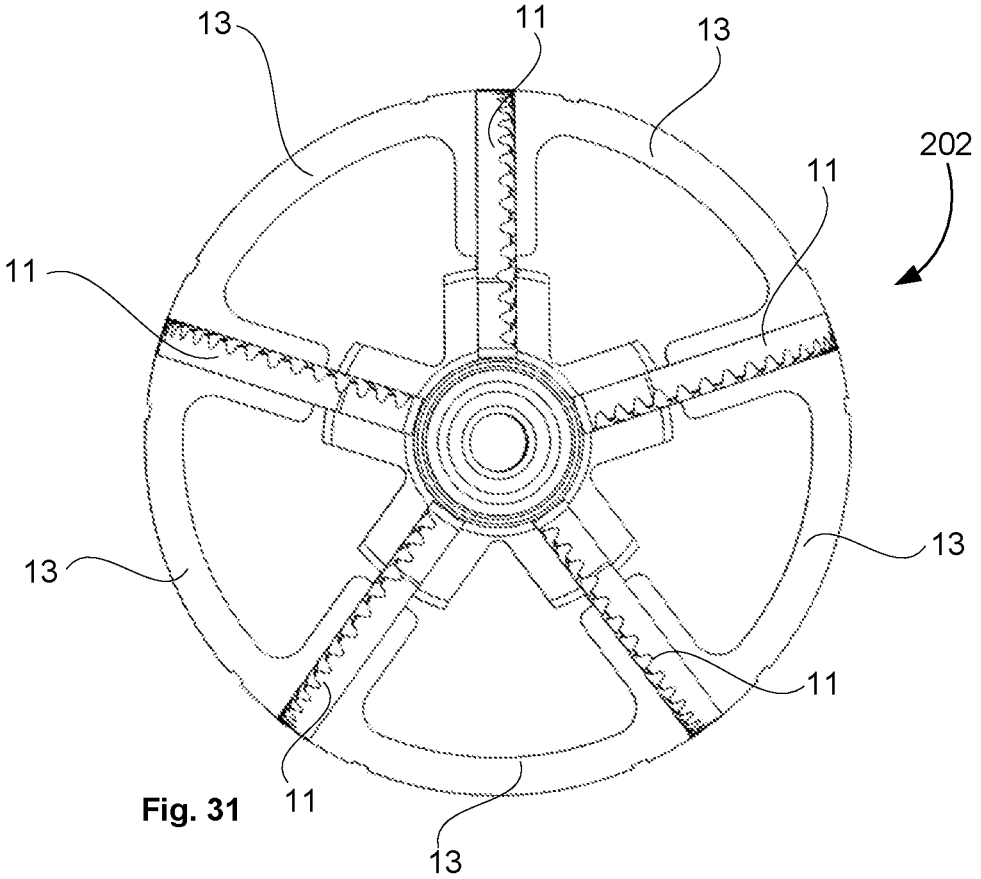
FIG. 31 is a front view of yet another reamer with five cutting wings and four ring segments.
Figure 32:
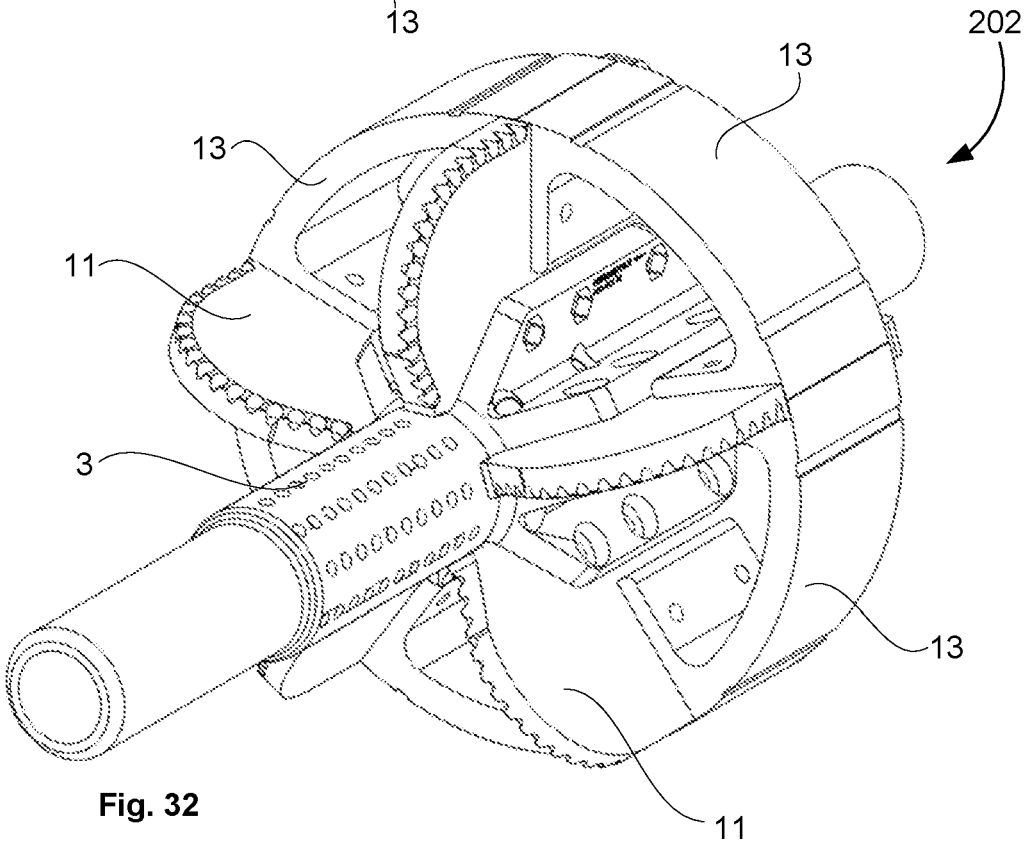
FIG. 32 is a perspective view of the reamer in FIG. 31.

FIGS. 31 and 32 illustrate an example of a reamer 202 202 with five ring segments 13 and five cutting wings 11. Each of the five ring segments 13 represent one fifth (i.e. 72 degrees) of the complete stabilization ring 17.

In some examples, a gap may be provided between ring segments 13 in an assembled stabilization ring 17, by having each segment represent a slightly smaller segment than the notional evenly divided amount. For example, in a five wing reamer, each of the five ring segments 13 may represent 71.5 degrees so that there is a gap of one half of a degree between ring segments. In alternative examples, instead of an angular gap, the gap may be a substantially constant width gap between the segments (i.e. flat surfaces offset from the centre).

Ring Segment 313 Bridging More Than Two Cutting Wings

Figure 33:
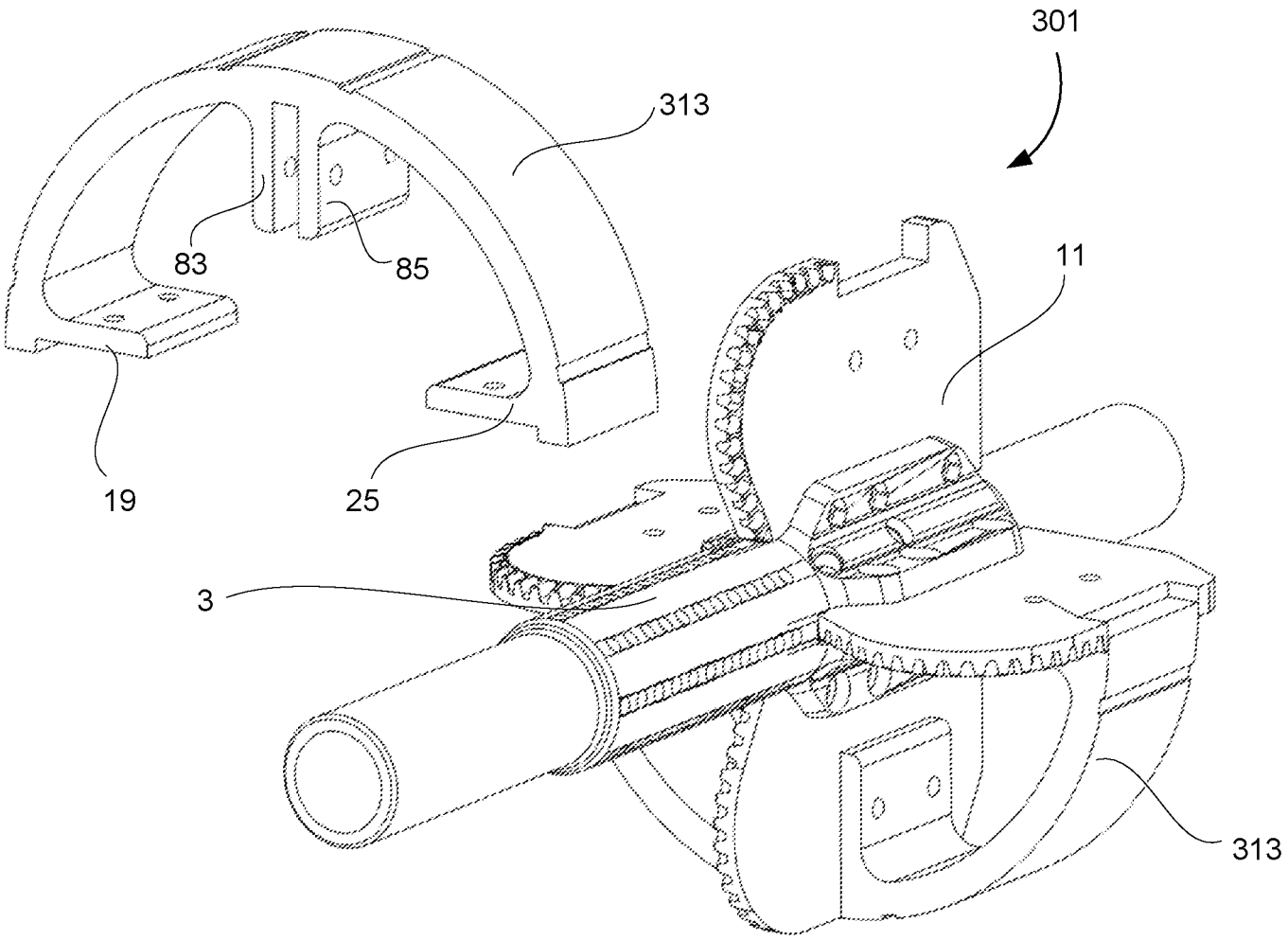
FIG. 33 is a perspective view of another reamer with ring segments that bridge across three cutting wings.

Although the illustrated examples show a ring segment 13 with the first end 21 and second end 27 bridging the outer edges 12 of two adjacent cutting wings 11, it is to be appreciated that in some variations, a ring segment 13 may bridge over the outer edges 12 of three or more cutting wings (11). Referring to FIG. 33, there is a four wing reamer 301 that has two ring segments 313 that are each one half of a stabilization ring 17. This includes intermediate flanges 83, 85 to receive a cutting wing 11 there between.

In another example, the ring segment 13 may be a one third segment of the stabilization ring that bridges over three outer edges 12 of a reamer with six cutting wings. Thus the number of ring segments 13 may be different to the number of cutting wings 11.

Ring Segments 313 Attached to One Another

Figure 34:
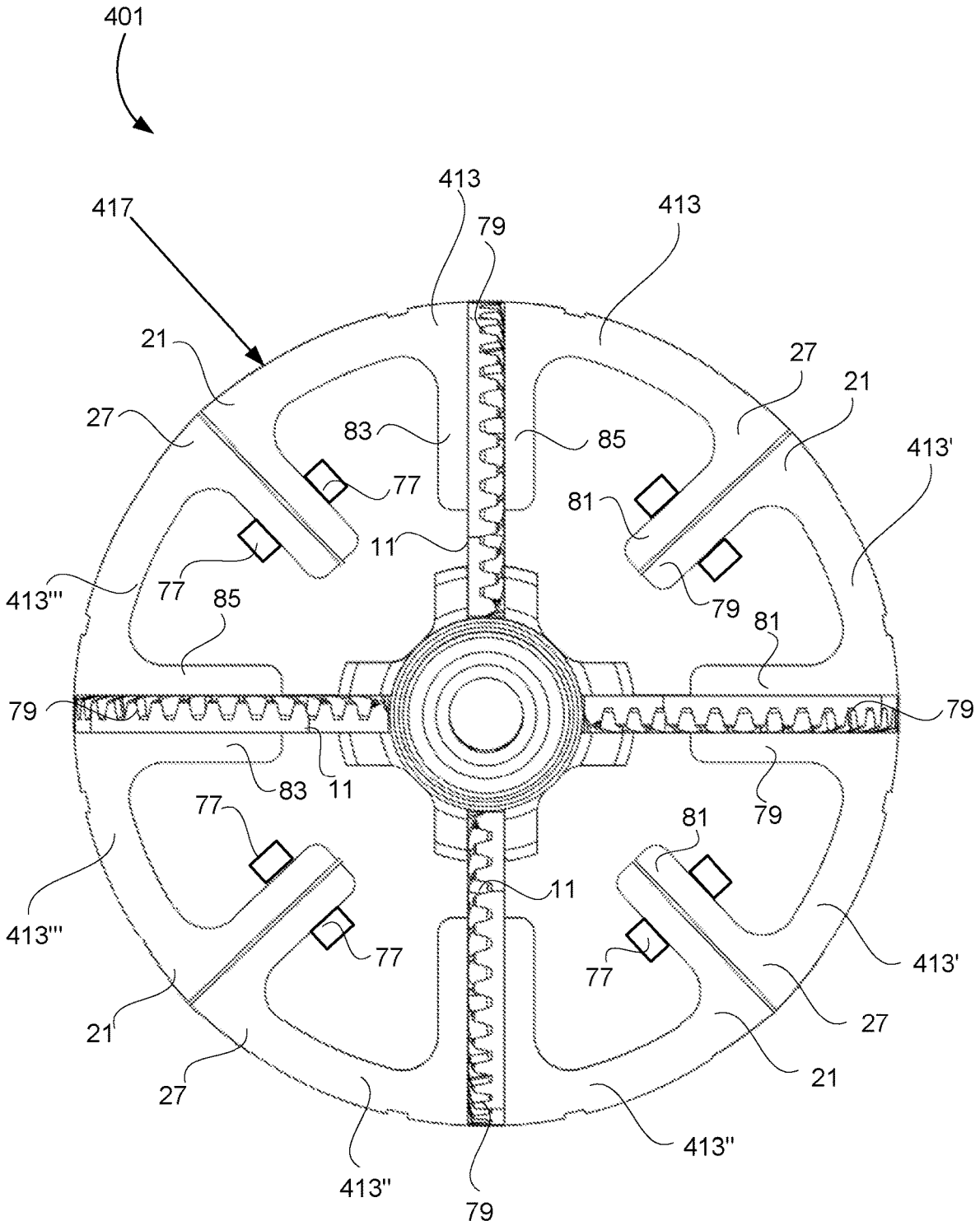
FIG. 34 is a front view of another reamer with ring segments attached to one another to form a stabilization ring spanning the cutting wings.

In yet another variation of the reamer 401 as shown in FIG. 34, the ring segment 413, 413', 413", 413'" may receive an outer edge of a single cutting wing 11 at an intermediate location 79 between the first end 21 and second end 27. This may include positioning the cutting wing 11 between intermediate flanges 83, 85 of the ring segment.

The first end 21 of one ring segment 13 may be fastened to the second end 27 of another ring segment 13. Thus the completed stabilization ring 417 may bridge over the outer edges 12 of the cutting wings 11, even though each individual ring segment 313 does not.

The ring segments 313 may include end flanges 79, 81 at the opposite ends, whereby apertures in the end flanges allow a fastener 77 to pass through to secure the ring segments 413, 413', 413", 413''' together. In this example, fasteners to fasten the ring segment to the cutting wings 11 are not required as the completed stabilization ring 417 encapsulates the cutting wings 11 to stay in position. However, in further examples, the intermediate flanges 83, 85 may have apertures to allow a fastener to pass through to provide further fastening between the stabilization ring 417 and the cutting wings 11.

Uneven Spacing for Variable Pitch

Figure 35:
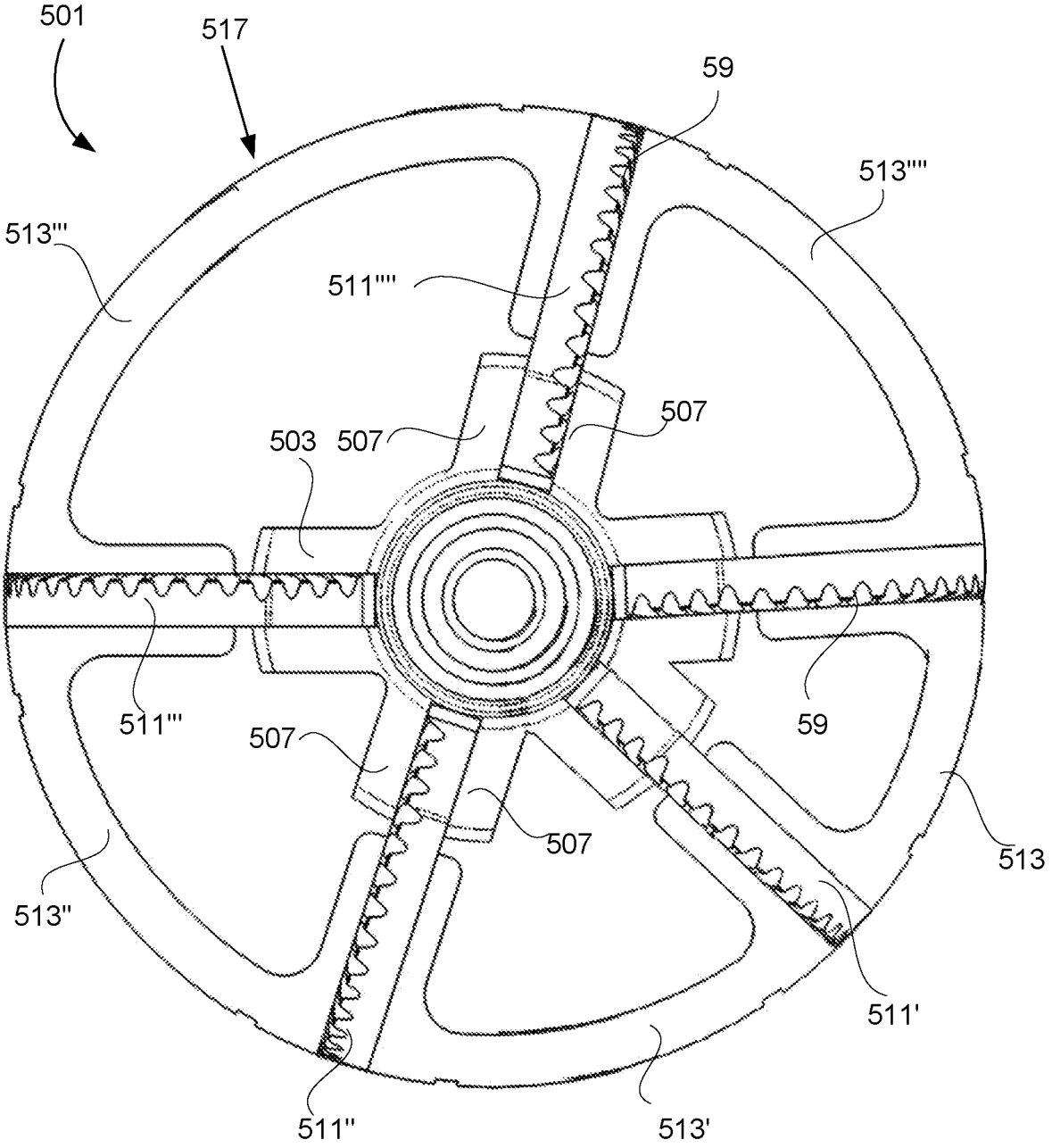
FIG. 35 illustrates a front view of another example of a reamer with uneven spacing between cutting wings.

In some examples of the reamer, the spacing between the cutting wings are not evenly spaced. Providing uneven spacing may be useful for a reamer with variable pitch of the cutting elements 59. This may include a progressively increasing pitch. FIG. 35 illustrates a reamer 501 with variable spacing between cutting wings 511. For example, the angular spacing between a first cutting wing 511 and adjacent second cutting wing 511' is relatively small. In contrast, the angular spacing a fourth cutting wing 511''' and adjacent fifth cutting wing 511'''' is relatively large. It is to be appreciated the spacing with other cutting wings may be configured according to the desired design pitch.

The uneven spacing of the cutting wings 511 may include other changes to the reamer including corresponding spacing of the support sings 507 at the support body 503. Furthermore, the size of the ring segments 513 may also differ. For example, a first ring segment 513 has a relatively smaller size to fit between the first and second cutting wings 511, 511'. This is compared to ring segment 513" which is relatively larger to fit in the larger spacing between the fourth cutting wing 511''' and fifth cutting wing 511''''.

Bi-Centre PDC

Figure 36:
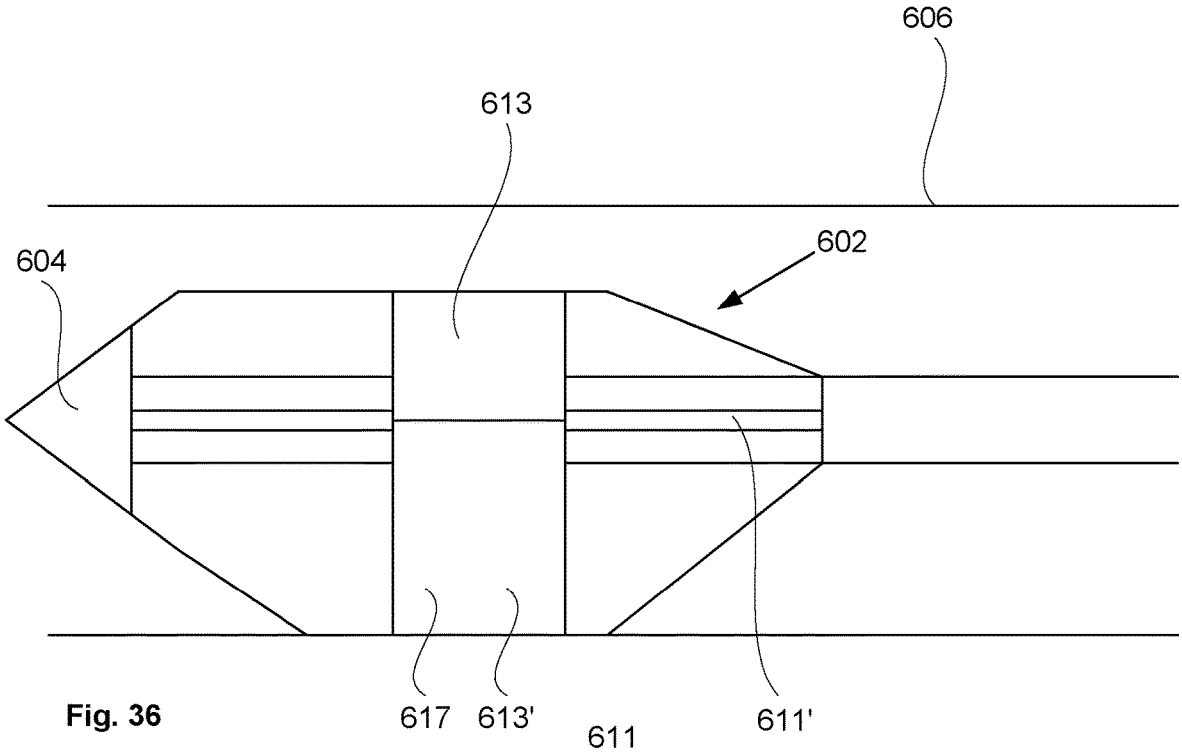
FIG. 36 is a sectioned side view of a bi-centre PDC cutter with an eccentric mounted ring.
Figure 37:
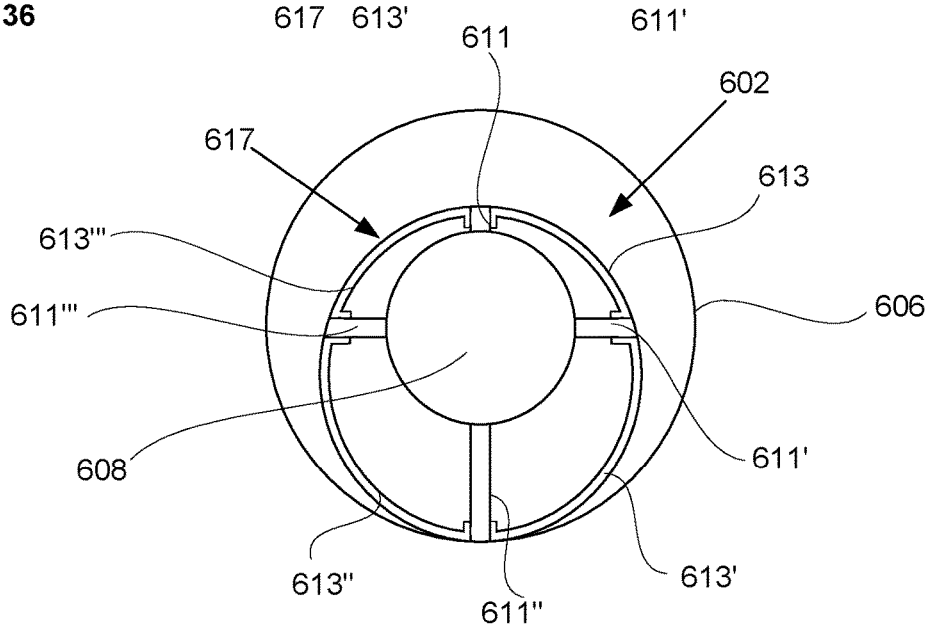
FIG. 37 is a front view of the PDC bit with eccentric ring.

FIGS. 36 and 37 illustrate another example application of the present disclosure. The ring segments 613 may be assembled to form a ring 617 to support components of a drill string 602 with a bi-centre PDC drill bit 604 to create a bore 606. The drill string 602 may include a plurality of wings 611, 611', 611", 611'''. The wings may include cutting element and, in some examples, there may be a combination where some wings 611 do not have cutting elements, whereas other wings 611" have cutting elements. The wings, 611, 611', 611", 611''' may be joined to one another by a ring 613 from strength and stability of the drill bit 604 and drill string 602. The ring 613 may be formed of a plurality ring segments 613, 613', 613", 613 that bridge the wings 611, 611', 611", 611'''. Thus in this example, the ring has an eccentric configuration where centre of the ring 617 is off-centre from the central axis of the drill string 602.

Fastening the Stabilization Ring to Other Components of the Reamer

In the examples described above, the stabilization ring 17 may be fastened to other components of the reamer 1, such as the cutting wing 11. However, it is to be appreciated that in some alternative examples, the stabilization ring 17 may be fastened to other components of the reamer 1 such as the radially extending support wings 7. In some examples, this may include fastening the stabilization ring 17 to the support wings 7 with fasteners passing through corresponding apertures in the flange portions of the ring segments and the support wings 7.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A reamer for underground passageways, comprising:

a support housing and a plurality of radially extending cutting wings;

a plurality of ring segments, wherein each ring segment includes an arcuate ring portion, wherein the plurality of ring segments are assembled with the cutting ring to form a stabilization ring bridging between radial outer edges of the plurality of cutting wings, wherein the stabilization ring is fastened to at least one of the cutting wings to resist radial movement of the reamer; and wherein each ring segment further comprises a first flange portion, the first flange portion located proximal to a first end of the arcuate ring portion and extends substantially inward towards a center of the stabilization ring.

2. A reamer according to claim 1, wherein each ring segment bridges the radial outer edges of two adjacent cutting wings.

3. A reamer according to claim 1 wherein each ring segment further comprises:

a second flange portion, wherein the second flange portion is located proximal to a second end of the arcuate ring portion opposite to the first end, the second flange portion extending substantially inwards towards the centre of the stabilization ring.

4. A reamer according to claim 3, wherein the first and second flange portions include a corresponding contact surface, wherein when assembled, the contact surfaces face a corresponding side surface of the cutting wing to transfer torsional forces between the stabilization ring and the cutting wings.

5. A reamer according to claim 4 wherein spaced apart pairs of adjacent first and second flange portions have corresponding opposing contact surfaces to face and receive a respective cutting wing.

6. A reamer according to claim 3, wherein the ring segment further includes extensions extending past respective junctions of the arcuate ring portion and the first and second flange portions, and wherein the cutting wing includes a recess to locate and receive the extensions of the ring segment.

7. A reamer according to claim 1 wherein the first flange portion include at least one ring segment aperture and the cutting wing includes at least one ring fastening aperture, wherein when assembled, the at least one ring segment aperture and at least one ring fastening aperture receives a fastener.

8. A reamer according to claim 1 wherein the stabilization ring further comprises at least one groove on an outwardly facing surface of the stabilization ring, wherein the at least one groove extends between opposite front and back ends of the stabilization ring.

9. A reamer according to claim 1 wherein the plurality of ring segments include two, three, four, five, six, seven, or eight ring segments to form the stabilization ring.

10. A reamer according to claim 1, wherein the support housing includes plural integral pairs of spaced apart radially extending support wings, wherein between each pair of support wings there is a longitudinally extending slot such that each cutting wing is received between a respective pair of support wings, wherein the cutting wings engage with the support housing to resist rearward longitudinal movement, and with the support wings to resist torsional forces between the cutting wings and the support housing.

11. A ring segment of a stabilization ring for a reamer according to claim 1.

12. A cutting wing for a reamer according to claim 1.

13. A kit for a reamer comprising:

one or more ring segments of a reamer according to claim 1; and one or more cutting wings of a reamer according to claim 1, wherein the ring segments and cutting wings, in use, are assembled with a support housing to form a reamer according to claim 1.

14. A ring segment for a stabilization ring of an underground reamer, the ring segment comprising:

an arcuate ring portion extending between a first end and an opposite second end, wherein in use, a plurality of arcuate ring portions are arranged end to end to form the stabilization ring, wherein the stabilization ring is fastened to other components of the reamer; and wherein each ring segment further comprises a first flange portion, the first flange portion located proximal to a first end of the arcuate ring portion and extending substantially inward towards a center of the stabilization ring.

15. A ring segment according to claim 14 further comprising:

a second flange portion, wherein the second flange portion is located proximal to the second end of the arcuate ring portion, wherein the second flange portion extends substantially inwards towards the centre of the stabilization ring.

16. A ring segment according claim 15, wherein the ring segment further includes extensions extending past respective junctions of the arcuate ring portion and the first and second flange portions, wherein in use, the extensions are located and received in respective recesses of other components of the reamer.

17. A ring segment according to claim 14, further comprising at least one groove on an outwardly facing surface of the arcuate ring portion, wherein when arranged to form the stabilization ring, the at least one groove extends between opposite front and back ends of the stabilization ring.

18. A ring segment according to claim 14, wherein the arcuate ring portion forms a one half, one third, one quarter, one fifth, one sixth, one seventh, or one eighth segment of the stabilization ring.

* * * * *